US011319134B2

(12) United States Patent
Huff et al.

(10) Patent No.: US 11,319,134 B2
(45) Date of Patent: May 3, 2022

(54) PRODUCT PACKAGING SYSTEM

(71) Applicant: MCS Industries, Inc., Easton, PA (US)

(72) Inventors: Brad William Huff, Nazareth, PA (US); Michael Lee Pyle, Sugar Grove, IL (US)

(73) Assignee: MCS Industries, Inc.

( * ) Notice: Subject to any disclaimer, the term of this patent is extended or adjusted under 35 U.S.C. 154(b) by 0 days.

(21) Appl. No.: 17/002,000

(22) Filed: Aug. 25, 2020

(65) Prior Publication Data

US 2020/0385191 A1 Dec. 10, 2020

Related U.S. Application Data

(62) Division of application No. 15/954,849, filed on Apr. 17, 2018, now Pat. No. 10,752,421.

(60) Provisional application No. 62/487,055, filed on Apr. 19, 2017.

(51) Int. Cl.

| | |
|---|---|
| ***B65D 81/127*** | (2006.01) |
| ***B65D 63/10*** | (2006.01) |
| ***B65D 81/05*** | (2006.01) |
| ***B65D 81/107*** | (2006.01) |
| ***B65D 85/48*** | (2006.01) |
| ***B65D 63/02*** | (2006.01) |

(52) U.S. Cl.

CPC ..... *B65D 81/127* (2013.01); *B65D 63/02* (2013.01); *B65D 63/10* (2013.01); *B65D 81/054* (2013.01); *B65D 81/055* (2013.01); *B65D 81/058* (2013.01); *B65D 81/107* (2013.01); *B65D 85/48* (2013.01); *B65D 2581/053* (2013.01); *B65D 2581/055* (2013.01)

(58) Field of Classification Search

CPC ..... B65D 81/127; B65D 85/48; B65D 63/02; B65D 63/10; B65D 81/054; B65D 81/055; B65D 81/058; B65D 81/107; B65D 2581/053; B65D 2581/055

USPC ..... 206/453, 586

See application file for complete search history.

(56) References Cited

U.S. PATENT DOCUMENTS

| | | | |
|---|---|---|---|
| 1,728,894 | A | 9/1929 | Oppenheim |
| 2,012,132 | A | 8/1935 | Morris et al. |
| 2,105,086 | A | 1/1938 | Joseph et al. |
| 2,134,130 | A | 10/1938 | Price |
| 2,187,382 | A | 1/1940 | Libbey |
| 2,226,215 | A | 12/1940 | Borah |

(Continued)

*Primary Examiner* — Steven A. Reynolds
(74) *Attorney, Agent, or Firm* — Belles Katz LLC

(57) ABSTRACT

A product packaging system in one embodiment includes a stack of products defining a pair of opposing major side surfaces, a top surface, a bottom surface, and pair of opposing end surfaces; protective corrugated sheets covering two or more of the stack side, top, and bottom surfaces; and a protective end pad covering each of the stack end surfaces. Each protective corrugated sheet includes a pair of longitudinally-extending and protruding corner reinforcement structures disposed along corner regions of the stack. The reinforcement structures are three-dimensional structures having different possible configurations which provide crush-resistance in the assembled product package. The product package collectively comprising the foregoing components is insertable into an outer shipping carton for transit. Some embodiments include banding which holds the stack of products together. In one embodiment, the products may be mirrors.

14 Claims, 19 Drawing Sheets

(56) References Cited

U.S. PATENT DOCUMENTS

| | | | | |
|---|---|---|---|---|
| 2,269,247 | A | 1/1942 | Borah | |
| 2,277,674 | A | 3/1942 | Russell | |
| 2,377,125 | A | 5/1945 | Borah et al. | |
| 3,939,978 | A | 2/1976 | Thomaswick | |
| 4,116,334 | A * | 9/1978 | Herzog | B65D 5/5035 206/453 |
| 4,955,480 | A * | 9/1990 | Sexton | B65D 81/18 206/438 |
| 5,071,009 | A | 12/1991 | Ridgeway | |
| 5,226,557 | A | 7/1993 | Nelson | |
| 5,267,663 | A | 12/1993 | Dykhouse | |
| 5,372,259 | A | 12/1994 | Suzuki et al. | |
| 5,501,339 | A | 3/1996 | Suzuki et al. | |
| 5,605,229 | A | 2/1997 | Sowa | |
| 6,268,039 | B1 | 7/2001 | Chou et al. | |
| 7,081,077 | B2 | 7/2006 | Southwell et al. | |
| 10,435,232 | B2 | 10/2019 | Hokanson et al. | |
| 2003/0111383 | A1 | 6/2003 | Qiu et al. | |
| 2005/0023334 | A1 | 2/2005 | Park et al. | |
| 2009/0065385 | A1* | 3/2009 | Kakuta | B65D 81/113 206/316.1 |
| 2013/0199954 | A1* | 8/2013 | Huard | B65D 85/48 206/454 |

* cited by examiner

PRODUCT PACKAGING SYSTEM

CROSS-REFERENCE TO RELATED APPLICATIONS

The present application is a divisional of U.S. patent application Ser. No. 15/954,849 filed Apr. 17, 2018, which claims the benefit of priority to U.S. Provisional Application No. 62/487,055 filed Apr. 19, 2017. The entireties of the foregoing applications are incorporated herein by reference.

BACKGROUND OF THE INVENTION

Product packaging is needed to prevent damage to products during handling and transit from the manufacturing facility to a retail store or warehouse and all stops in between. One product in particular that suffers from a high percentage of defectives during transit is mirrors due to their inherent fragility. Breakage may result from impact forces caused by dropping the packaged product or contact with adjoining packages or hard surfaces during handling. Thus, a need exists for product packaging that limits or eliminates damage of the product during handling, transit, and storage.

SUMMARY OF THE INVENTION

Embodiments of the present invention provide a product packaging system with improved impact resistance resulting in minimal or no breakage of the product during handling and transit. In one non-limiting example, the product may be framed or frameless flat mirrors.

In one aspect, a product packaging system comprises: a longitudinal axis; a stack of products arranged in abutting relationship, the stack defining a pair of opposing major side surfaces, a top surface, a bottom surface, and pair of opposing end surfaces; a plurality of protective corrugated sheets, each of the side, top, bottom, and end surfaces of the stack covered by one of the protective corrugated sheets; each protective corrugated sheet including a pair of longitudinally-extending protruding corner reinforcement structures, the corner reinforcement structures disposed along corner regions of the stack; a protective end pad covering each of the end surfaces of the stack; the stack of products, protective corrugated sheets, and protective end pads collectively defining a product package which is removably insertable inside an outer shipping carton.

In another aspect, a product packaging system comprises: a longitudinal axis; a stack of products arranged in abutting relationship, the stack defining a pair of opposing major side surfaces, a top surface, a bottom surface, and pair of opposing end surfaces; a pair of protective corrugated sheets, each of the top and bottom surfaces of the stack covered by one of the protective corrugated sheets; each protective corrugated sheet including a pair of longitudinally-extending protruding corner reinforcement structures, the corner reinforcement structures disposed along corner regions of the stack; a protective end assembly covering each of the end surfaces of the stack, the protective end assembly including a deformable protective end pads and a U-shaped corrugated sheet covering the end pad; the stack of products, protective corrugated sheets, and protective end assemblies collectively defining a product package which is removably positioned inside an outer shipping container.

DETAILED DESCRIPTION OF THE INVENTION

Figure 1A:
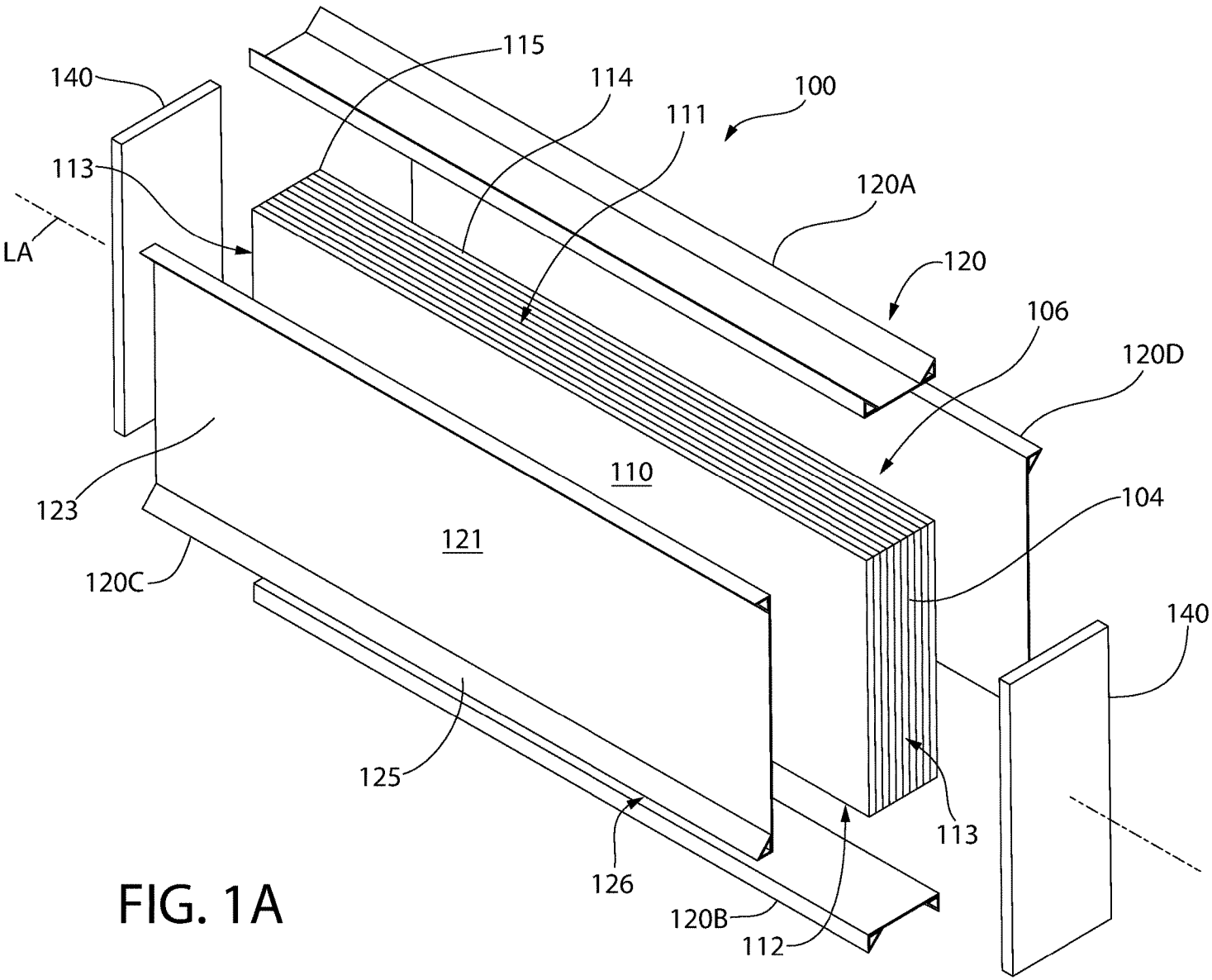
FIG. 1A is an exploded perspective view of a packaged product in accordance with a first embodiment of the present invention.

The following description of the exemplary ("example") embodiment(s) of the invention is merely illustrative in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

The present invention relates to product packaging, and more specifically to packaging for mirrors that substantially decreases or even eliminates product damage during transit from the manufacturing facility to its final destination prior to consumer purchase. The packaging shown and described herein significantly decreases the number of units that may be damaged (i.e., the number of mirrors that are broken) during shipping by ensuring adequate protection of the mirrors during all stages of transit from factory to shelf.

FIGS. 1A-1D illustrate a first embodiment of a product packaging system 100 according to the present invention. Specifically, FIGS. 1A-1D illustrate various sequential stages in a method or process of packaging a set of products into a product package 102 for placement in an outer shipping container or carton 130. In one embodiment, the products may be mirrors 104 recognizing that other types of products of similar configuration may be packaged in the same manner using the same product packaging system. In the embodiment shown, each package 102 includes ten mirrors 104, although more or less than ten mirrors may of course be used in other package embodiments. Furthermore, although the invention is described herein with regard to the packaging of mirrors, the invention is not to be so limited in all embodiments and any other product may be packaged as described herein where desired to reduce or prevent damage or breakage of the product during handling and transit. The mirrors 104 may be packaged in a face-to-face and back-to-back arrangement in the exemplified embodiment, although face-to-back arrangements may also be possible in some alternative embodiments.

The mirrors 104 may each be longitudinally elongated in a direction of a reference longitudinal axis LA of the package 102. A lateral direction is defined as being transversely oriented to longitudinal axis LA for convenience of description. Mirrors 104 each have a flat rectangular shape in one non-limiting embodiment as shown with opposing parallel sides defining a mirrored front face or side and plain back side. Mirrors 104 have a thickness (front to back) substantially less than the width or length of the mirror. Mirrors 104 may be framed or unframed.

In the exemplified embodiment, the mirrors 104 are placed in tightly abutting relationship with nothing interspersed between each mirror to collectively form a stack 106 of mirrors. The mirrors 106 may be arranged in the face-to-face and back-to-back arrangement to form a stack 106 of the mirrors in one embodiment. In other possible embodiments, the mirrors 106 may be arranged in face-to-back relationship. Preferably, each mirror in the stack has the same dimensions (e.g. length, width, and thickness). The stack 106 of mirrors collectively defines opposing first and second major side surfaces 110, a top longitudinal edge surface 111, opposing bottom longitudinal edge surface 112, and opposing first and second end surfaces 113. The major side surfaces 110 may be considered to define front and rear surfaces for convenience of reference (the front surface being the one facing forward in FIG. 1A). The term "major" as used above and herein connotes that the side surfaces 110 in the embodiment shown are each dimensionally larger than the other exposed surfaces of the stack which are smaller. A plurality of longitudinal corner edges 114 of the stack 106 are defined at the intersection of the stack surfaces. Four longitudinal corner edges 114 in total are formed and not to be confused with the eight end corners 115 formed by the intersection of end surfaces 113 variously with the top longitudinal edge surface 111, bottom longitudinal edge surface 112, and major side surfaces 110.

In the present embodiment, the first and second major side surfaces 110, the top longitudinal edge surface 111, and the bottom longitudinal edge surface 112 of the mirror stack 106 are covered with a plurality of specially configured three-dimensional protective corrugated sheets 120 formed of a dense paper typically used for such corrugated sheets in the art. The term "three-dimensional" is used above and herein to distinguish such structures from simply flat corrugated packing sheets sometimes used package shipping. Sheets 120 therefore include a separate top corrugated sheet 120A, opposing bottom corrugated sheet 120B, and a pair of lateral side corrugated sheets 102C, D arranged in opposing relationship. Sheets 120 each comprise a flat central portion 121 and an opposing pair of longitudinal rolled ends 125 along peripheral edges of the sheet. Each corrugated sheet 120 is longitudinally elongated having a rectangular configuration with a greater longitudinal length (measured along longitudinal axis LA) than width (measured between the rolled ends 125). In the exemplified non-limiting embodiment, the protective corrugated sheets 120 may be made of a rolled 150# B-flute corrugated sheet. However, other suitable paper grades, weights, flute profiles/sizes, etc. may be used for the corrugated sheet in other embodiments. Accordingly, the foregoing is merely one exemplary type of corrugated sheet that may be used in accordance with the present invention. The protective corrugated sheets 120 may be somewhat flexible and can assume have a non-planar shape prior to being banded to the mirror stack 104 as further described herein. Each protective corrugated sheet 120 preferably is dimensioned to cover the entirety of the surface of the stack 106 on which it is positioned.

Figure 1B:
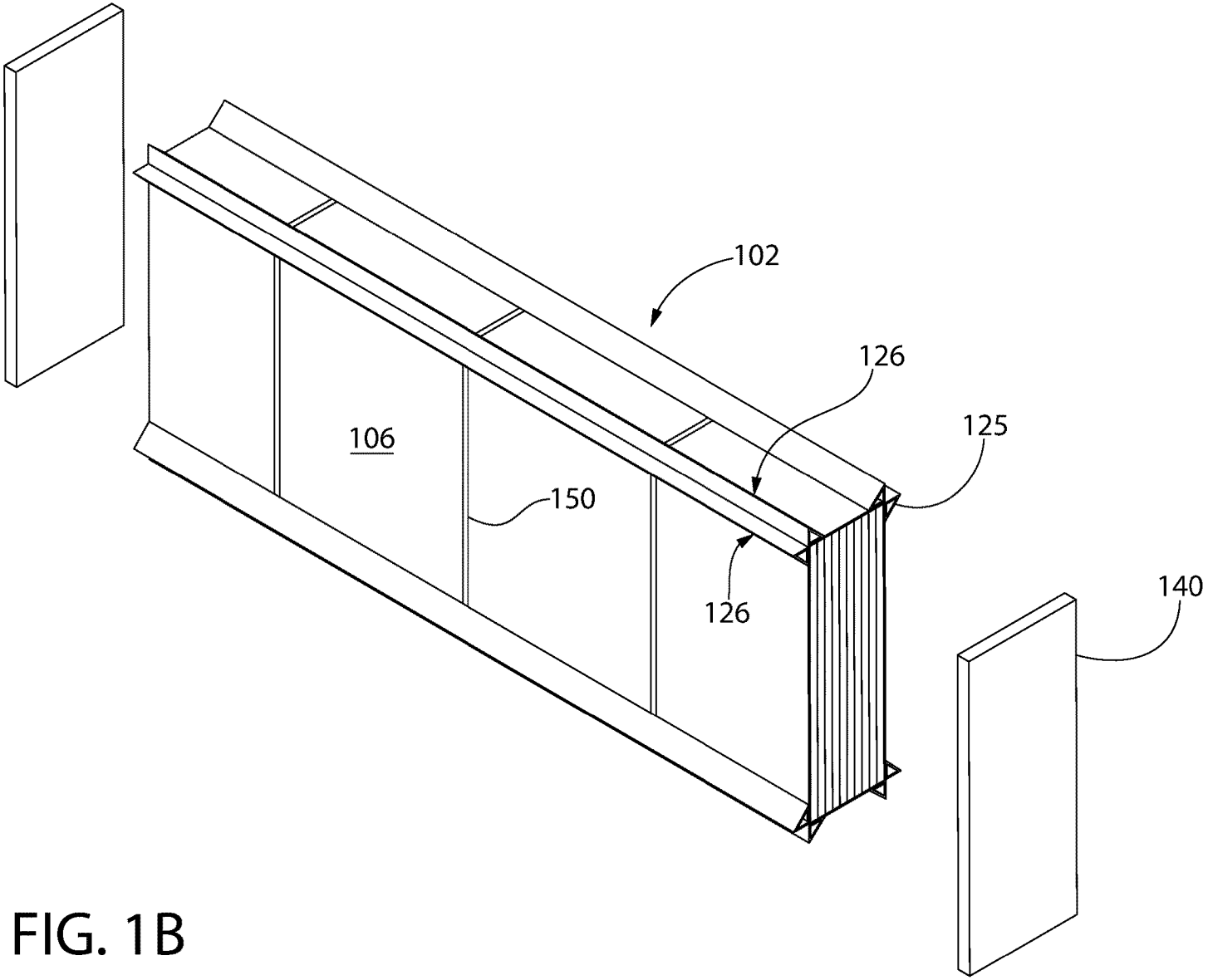
FIG. 1B is a partially assembled view of the packaged product of FIG. 1A
Figure 1C:
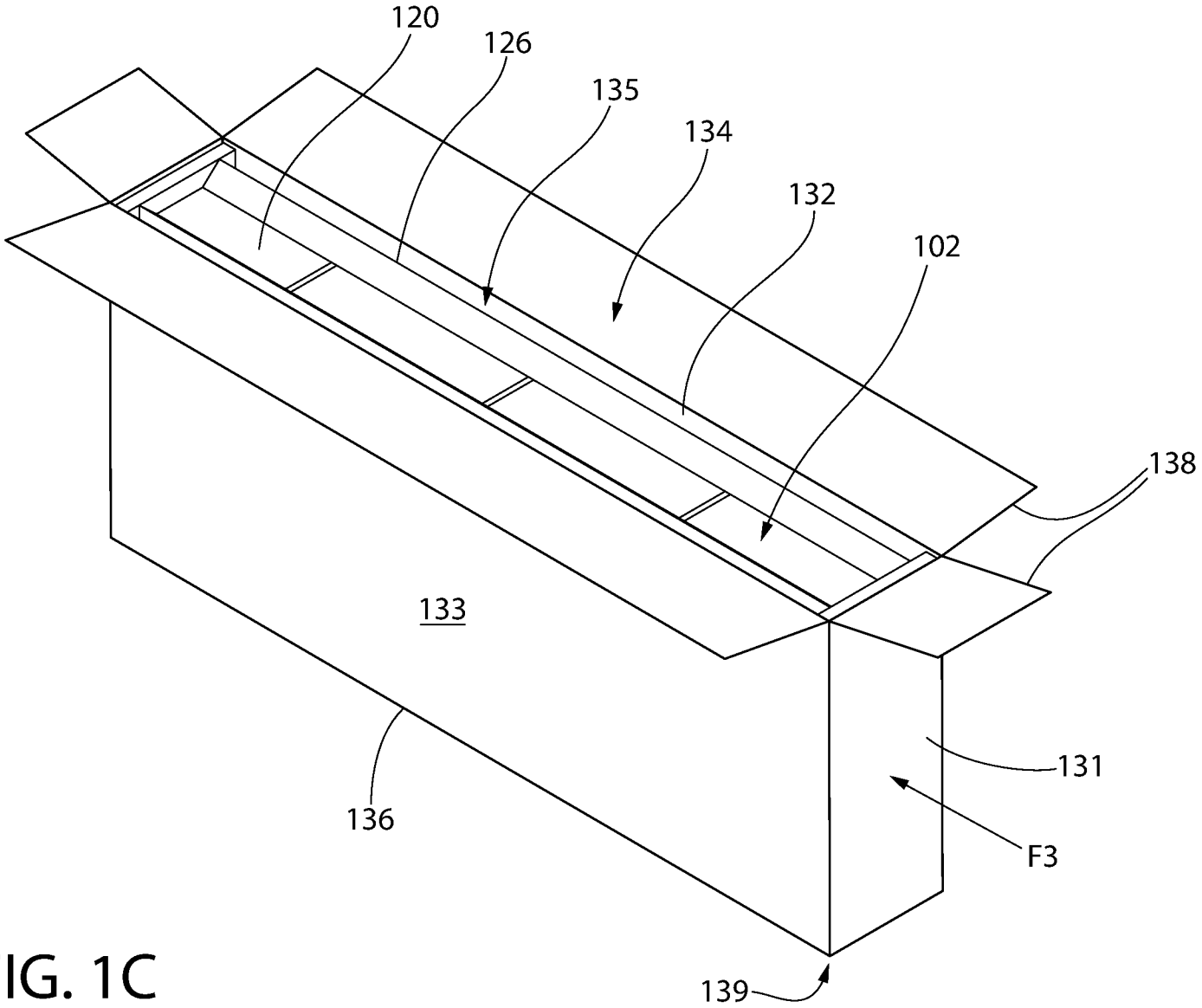
FIG. 1C is a fully assembled view of the packaged product of FIG. 1A.
Figure 1D:
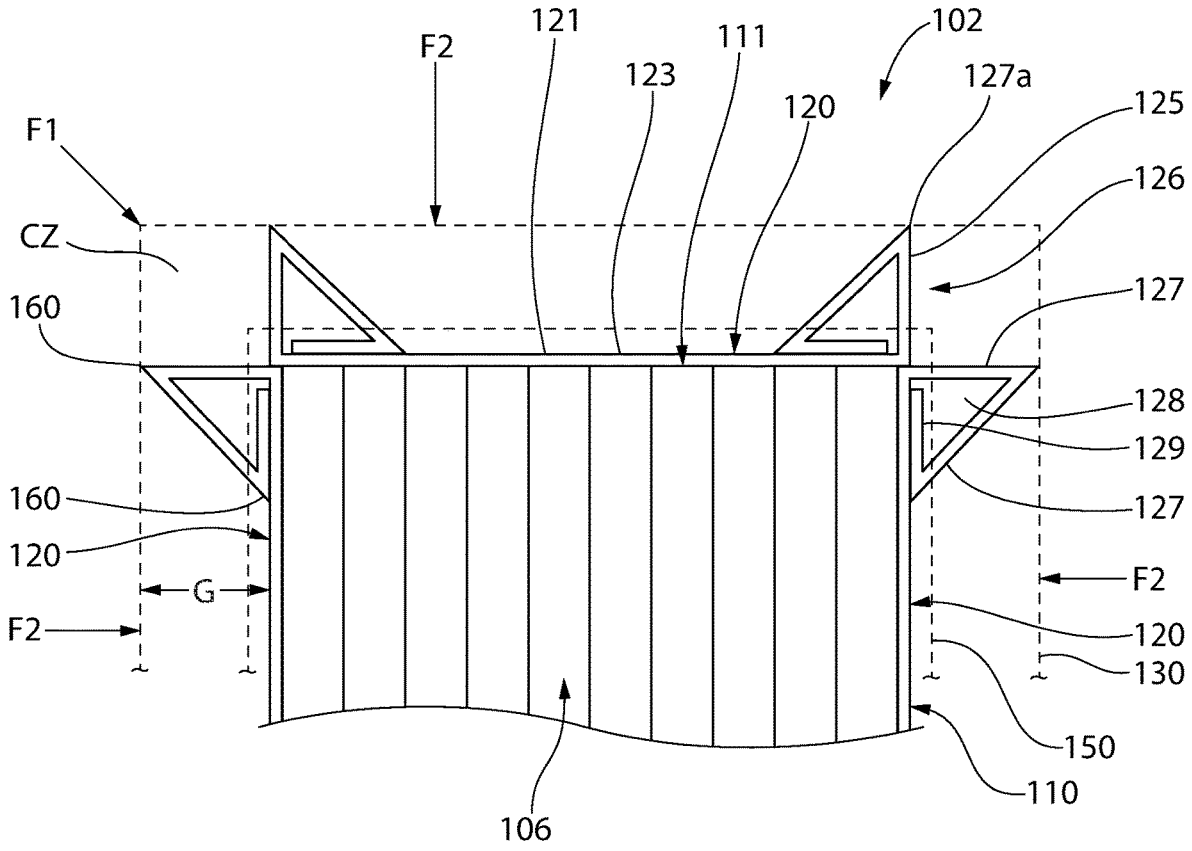
FIG. 1D is a schematic cross-sectional view of a top end portion of the packaged product of FIG. 1A.

The longitudinal rolled ends 125 of each protective corrugated sheet 120 increases protection of the assembled package 102 of mirrors 104 (best seen in FIG. 1D). The corrugated sheet 120 includes a flat horizontal wall 123 extending transversely between the rolled ends 125 in the assembled package 102 which completely covers the end surfaces 113 of the mirror stack 106. The longitudinal end portions of each corrugated sheet 120 are bent along three distinct longitudinal crease or bend lines 160 for forming rolled ends 125 with a three-dimensional structure of generally triangular configuration in transverse cross section. Each triangular shaped rolled end 125 as shown may include two unattached free outer walls 127 and a recurvant third inner wall 129 which is tucked under one of the outer walls and contacts an adjacent portion of the central portion 121 of the sheet 120 beneath the outer walls. The inner wall 129 of each rolled end 125 of the corrugated sheet 120 may be glued onto the adjacent portion of the sheet 120 in one possible construction to retain the shape of the rolled end. In other constructions the inner wall 129 is not glued down. The outer walls 127 are obliquely arranged to each other forming an apex 127*a* therebetween which represent the maximum projection of the rolled end 125 from the package 102 and corrugated sheet 120. Each apex is positioned adjacent to a corresponding inside longitudinal corner of the shipping carton 130 extending between carton ends 131. The walls 127 and 129 collectively define an open but enclosed interior space 128 within the rolled end 125 allowing some deformation of the rolled ends 125 An acute triangle may be formed by walls 127 and 129 in one embodiment as shown.

Accordingly, the longitudinally-extending rolled ends 125 of each protective corrugated sheet 120 can be considered to each define a protruding impact and crush-resistant triangular corner reinforcement structure 126 extending the full longitudinal length of the package 102, which are capable of withstanding a reasonable inwardly-directed external impact force directed against shipping carton 130. The corner reinforcement structures 126 thus form bracing which protects the corner regions of the assembled mirror package 102 when positioned inside the outer shipping carton 130 as shown in FIG. 4.

The corner reinforcement structures 126 provide multiple levels of impact and crush resistance. First, each corner region of the fully assembled package 120 and stack 106 of mirrors 104 is protected by two reinforcement structures 126 with one each located on perpendicularly oriented and adjoining surfaces 110-113 of the mirror stack 106. Reinforcement structures 126 thus straddle each corner of the mirror stack 106 and create a crush zone CZ at each corner region. If a diagonally acting external impact force F1 is directed at the corner region of the outer shipping carton 130 (see, e.g. FIG. 4), the corner of the container may partially collapse inwards and then transfer the impact forces to the pair of reinforcement structures 126 in the corner region of the mirror stack 106. The corner reinforcement structures 126 are deformable and crushable to an extent to protect the stack 106 of mirrors 104 from damage. The open interior space 128 formed within each reinforcement structure 126 provides room for deformation of the structure. The protruding walls 127 of each reinforcement structure 126 which meet at an apex 127*a* create a three-dimensional structure which is resistant to crushing to a reasonable extent. An impact force F1 acting on the apex 127*a* will be divided between both walls 127 and transferred to the and distributed across central portion 121 of the protective corrugated sheet 120 to lessen the force imparted to the stack 106 of mirrors 104, thereby providing improved crush resistance.

In addition to protecting the product package 102 against corner impacts, the protruding corner reinforcement structures 126 also create standoffs or spacers that provide a second level of protection against impact forces acting in an orthogonal plane to the protective corrugated sheet 120 and stack 106 of mirrors 104 between the short end surfaces 113 of the stack 106. This results from the protruding reinforcement structures 126 also forming a protective gap G extending circumferentially around the mirror stack 106 between the outer shipping carton 130 and the stack of mirrors 104 in areas of the stack and package between the corners regions (e.g. along the front and rear major side surfaces 110, the top longitudinal edge surface 111, and opposing bottom longitudinal edge surface 112. This includes protection against orthogonal impact forces F2 acting in a direction toward the front and rear major side surfaces 110, top longitudinal edge surface 111, and bottom longitudinal edge surface 112 (see, e.g. FIG. 1D). Accordingly, this enables the outer shipping carton 130 to deform and deflect to a degree for at least some protection against impacts directed at the assembled mirror package 102 between the corner regions. In some embodiments, additional protective reinforcement materials such as expanded polyethylene (EPE) foam, Styrofoam, or other materials may optionally be inserted in the gaps G of the product package 102 to increase impact resistance in these long non-corner regions when added protection is required.

Referring again to FIGS. 1A-1D, the product packaging system 100 further includes a pair of deformable and crushable protective end sheets or pads 140. The first and second end surfaces 113 of the stack 106 of mirrors 104 are each covered with a protective end pad 140 for protection against orthogonal impact forces F3 acting on the ends 131 of the shipping carton 130 (see, e.g. FIG. 1C). The end pads 140 will deform under impact force F3 to absorb of the force without transferring it to the stack 106 of mirrors 104 to prevent damage.

In one non-limiting embodiment, expanded polyethylene (EPE) foam may be used for the protective end pad 140. However, other crushable/deformable materials such as Styrofoam, etc. may be used in other embodiments. The EPE pad 140 is deformable and crushable to absorb the end-acting impact force F3 on the carton. In one non-limiting representative example, the EPE pad may be 2.5 cm thick, although the invention is not to be limited to such a dimension in all embodiments and other thickness may be used. Each of the EPE protective end pads 140 may have a rectangular configuration in one embodiment and are dimensioned to cover the entirety of the first or second end surfaces 113 on which they are positioned. Thus, the entirety of the exposed outer end surfaces 113 of the stack of mirrors 104 is covered by the EPE protective end pads 140. It bears noting that all exposed surfaces of the stack 106 of mirrors 104 is covered by either a protective end pad 140 or a protective corrugated sheet 120.

As shown in FIG. 1B, banding 150 is threaded through the rolled protective corrugated sheets and transversely/circumferentially around the stack 106 of mirrors 104 to hold everything tightly together and in place in the product package 102. This not only keeps the mirrors 104 in tight abutting relationship in the stack 106, but maintains the position of the protective corrugated sheet 120 relative to the stack to avoid slippage within the shipping carton 130. A plurality of longitudinally spaced apart bands 150 may be used which circumscribe the mirror stack 106 in a direction transverse to the longitudinal axis LA of the product package 102. The banding 150 may be made of plastic (e.g. polypropylene, polyester, etc.) or metal strap material. In other embodiments, the banding may be omitted.

Finally, all of the foregoing components which define the product package 102 are placed into the outer shipping carton 130, such as a heavy duty paper corrugated double-wall full overlap master carton or the like as shown in FIG. 1C. Thus, the mirrors 104 have multiple layers of protection provided by the outer master carton 130, the corrugated sheets 120, and the EPE foam end pads 140. The carton 130 may have a 200# test rating in one embodiment; however, other suitably rated cartons may be used. Carton 130 has a rectangular cuboid configuration in one embodiment as shown. Double wall cartons are generally comprised of three heavy duty paper facing sheets (two outer and one intermediate) and two inner corrugated sheets all glued together to form a strong sandwich type composite construction which resists impact. Other type of shipping containers however may be used and does not limit the invention.

The carton 130 includes a top 134, bottom 136, opposing ends 131, major front and rear faces 133, 137. A plurality of corners 139 are defined at the intersection of the top, bottom, ends, and front and rear faces. An interior cavity 135 is circumscribed by inside surfaces 132 of carton 130 and receives the assembled product package 102 therein. The top 134 may be closed by openable/closeable flaps 134*a* (four total in this illustrated embodiment).

A method for packaging a product such as mirrors 104 using the product packaging system 100 may be summarized as follows. The method generally includes: arranging the mirrors 104 in abutting relationship (e.g. face-to-face and back-to-back) to form the stack 106; positioning one of the four protective corrugated sheets 120 against each surface 110, 111, and 112; threading each of the bands 150 through and engaging the protective corrugated sheets 120 such as through the corner reinforcement structures 126 formed by the rolled ends 125 of the sheets; securely wrapping the threaded bands 150 transversely around the stack 106 and tightening the bands; inserting the banded stack 106 of mirrors 104 and protective corrugated sheets 120 inside the cavity 135 of the shipping carton 130; inserting a protective end pad 140 into the carton between the end surfaces 113 of the stack 106 and ends 131 of the carton 130; and closing the flaps 134*a* on the carton to secure the contents. Variations in the method and sequence of steps may be used in some embodiments.

Figure 2A:
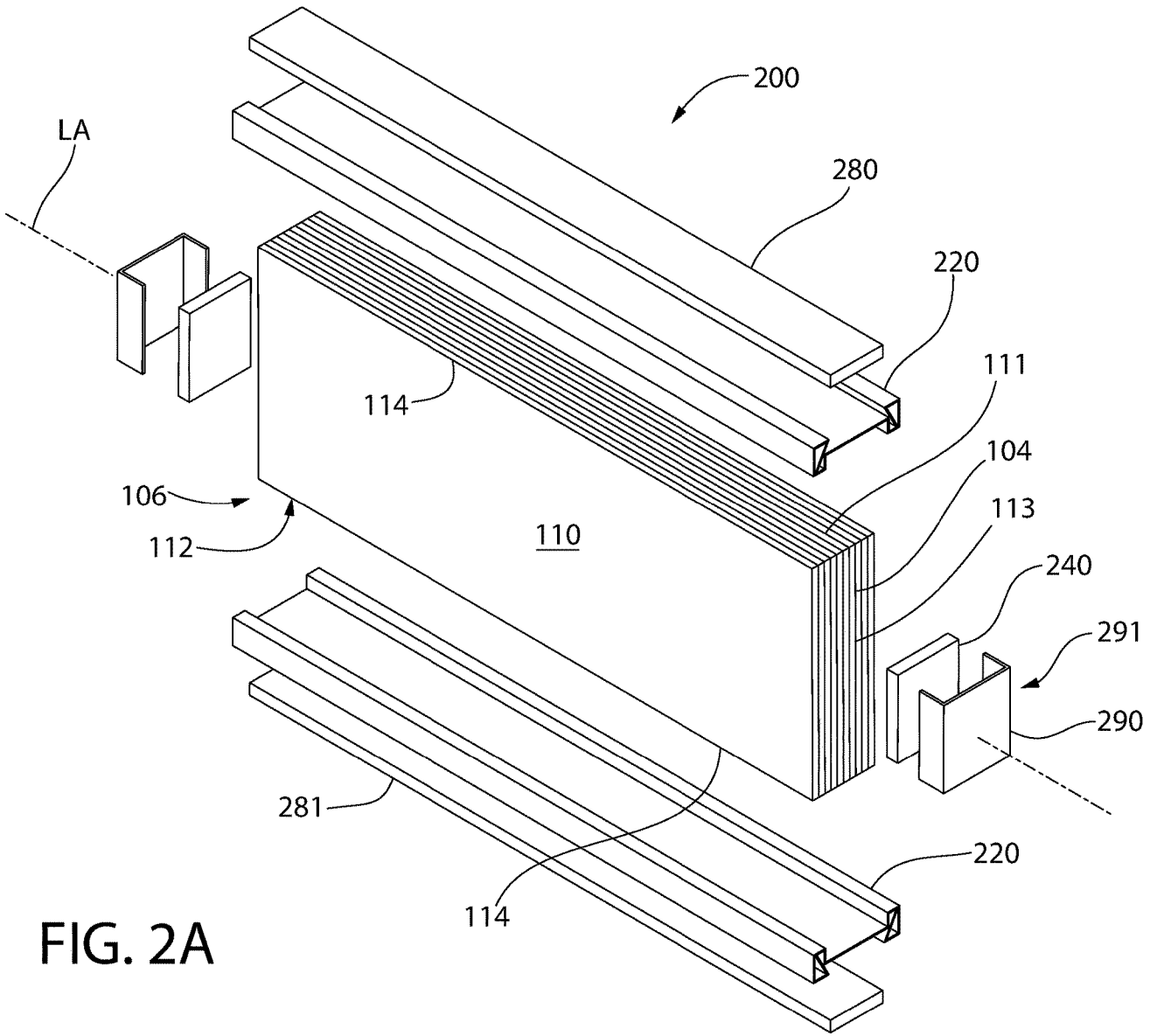
FIG. 2A is an exploded perspective view of a packaged product in accordance with a second embodiment of the present invention.
Figure 2B:
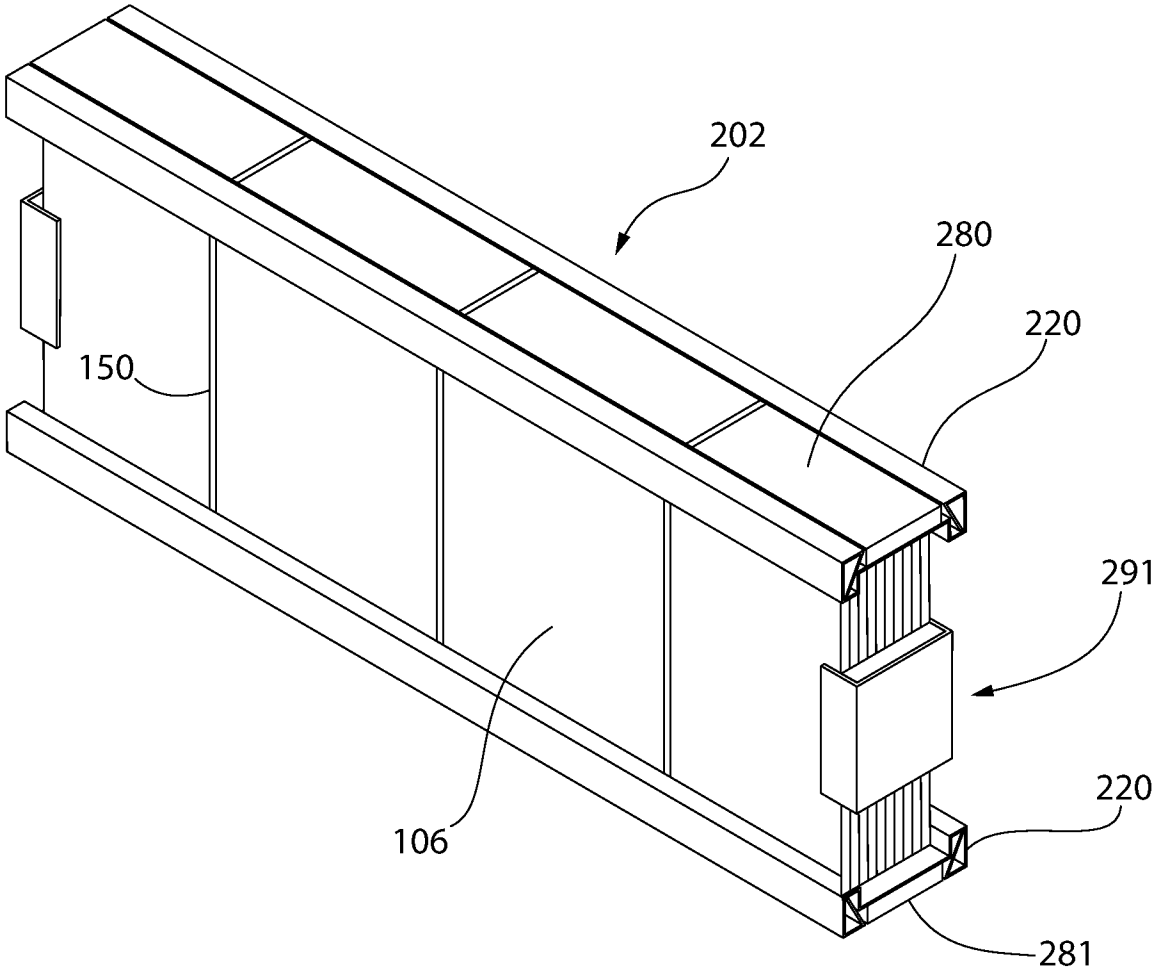
FIG. 2B is a partially assembled view of the packaged product of FIG. 2A
Figure 2C:
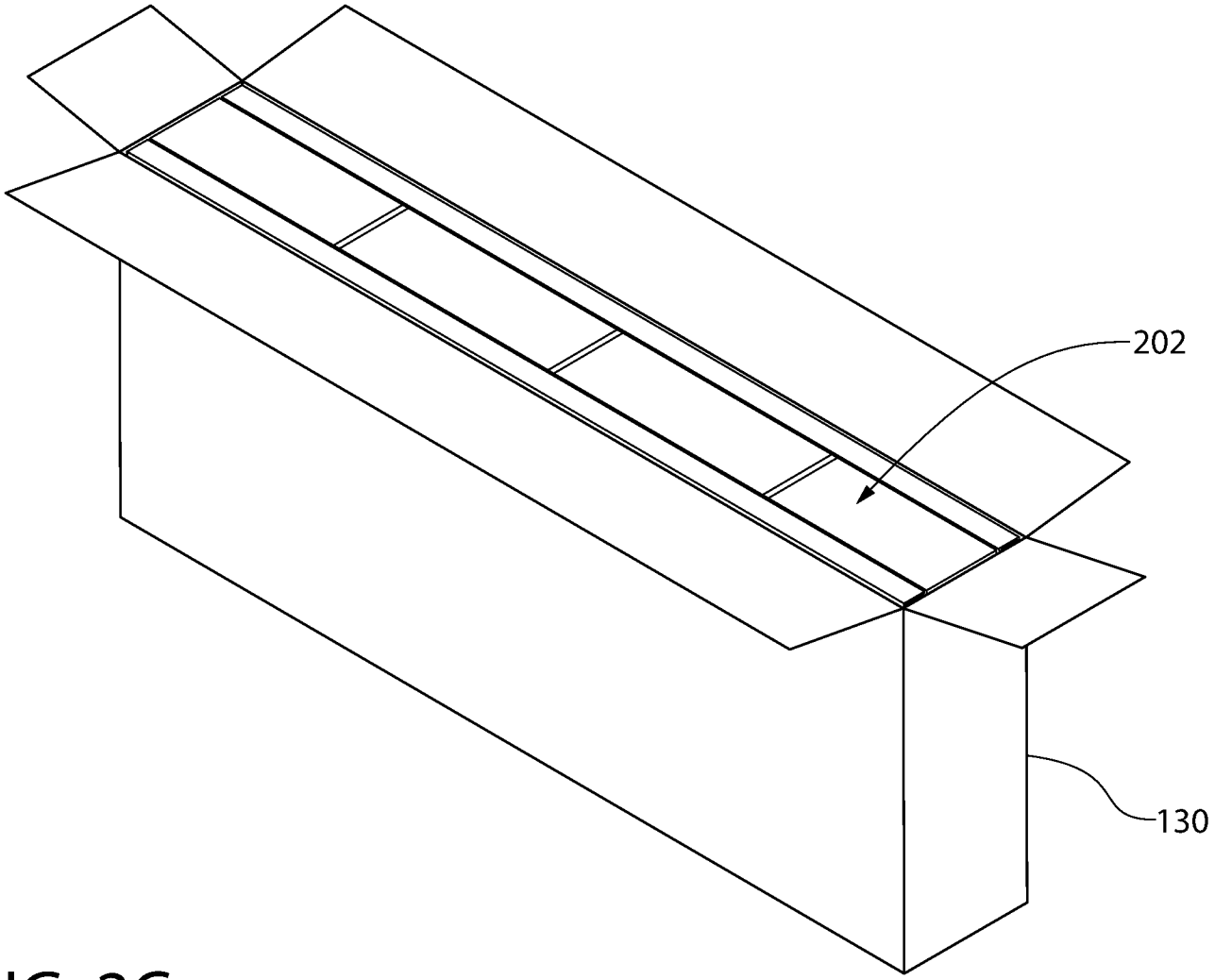
FIG. 2C is a fully assembled view of the packaged product of FIG. 2A.
Figure 2D:
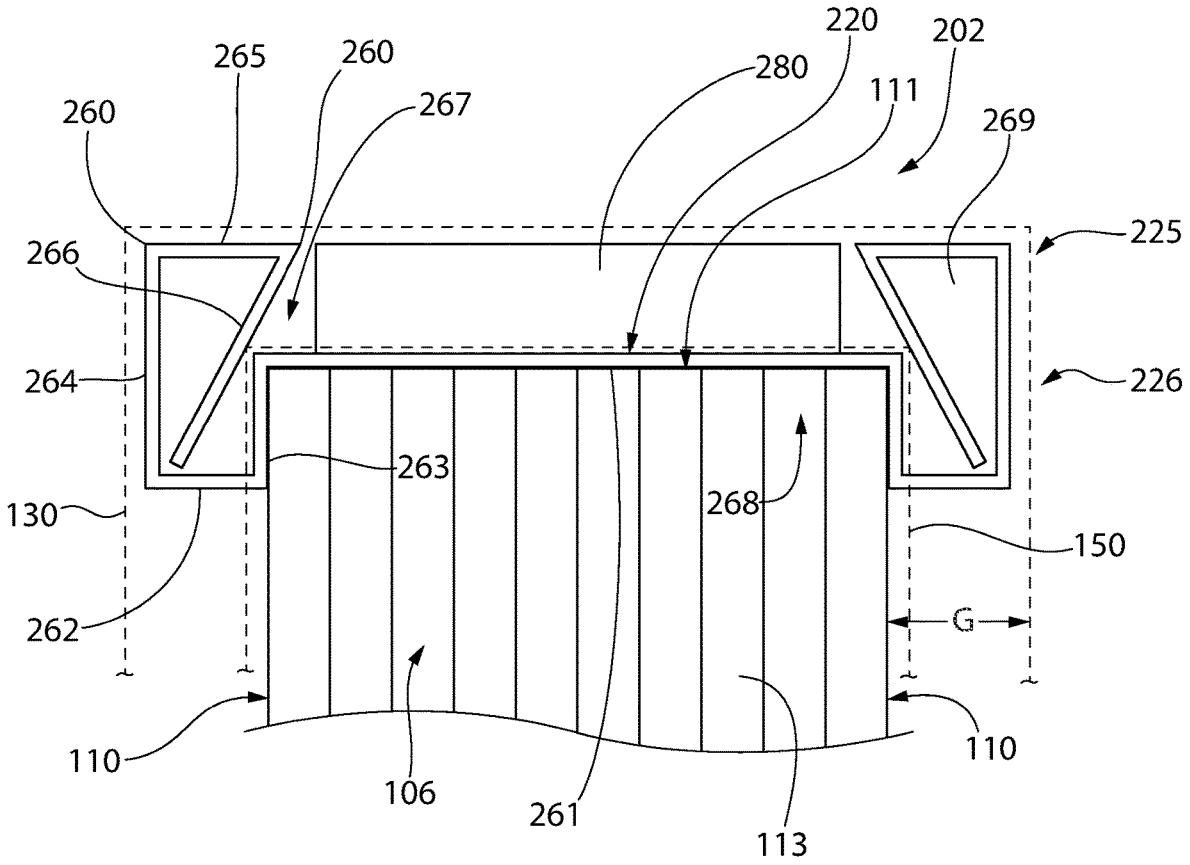
FIG. 2D is a schematic cross-sectional view of a top end portion of the packaged product of FIG. 2A.

FIGS. 2A-2D illustrate a second embodiment of a product packaging system 200 according to the present invention. Specifically, FIGS. 2A-2D illustrate various sequential stages in a method or process of packaging a set of products into a product package 202 for placement in an outer shipping container or carton 130. In this embodiment, again the mirrors 104 may be placed front-to-front and back-to-back in the stack 106 previously described herein which may include ten of the mirrors. In this embodiment, the top and bottom longitudinal edge surfaces 111, 112 of the stack 106 of mirrors 104 are covered with a specially configured three-dimensional and longitudinally-extending protective corrugated sheet 220 (e.g. 150# B-flute corrugated sheet in the exemplified embodiment). The shape of the corrugated sheets is best seen in FIG. 2D. The corrugated sheets 220 wrap over and around or the top and bottom surfaces 111, 112 to cover a portion of the first and second major side surfaces 110 of the stack 106 of mirrors. The longitudinal end portions of the corrugated sheets 220 are recurvant and bent so as to curl back onto themselves to create rolled ends 225 producing three-dimensional crush-resistant corner reinforcement structures 226 in a generally similar manner to, but shaped differently than corner reinforcement structures 126. This increases the protection provided by the corrugated sheets 220 along the corners/edges of the stack 106 of mirrors 104. The longitudinal end portions of each corrugated sheet 220 are bent along five distinct longitudinal crease or bend lines 260 for forming reinforcement structures 226 with a complex configuration including an external rectangular shaped portion and shape, and internal triangular shaped portion and shape (in transverse cross section as seen in FIG. 2D).

Each corrugated sheet 220 with longitudinally-extending reinforcement structures 226 includes a flat horizontal end wall 261 extending transversely and laterally between the corner reinforcement structures 226 in the assembled package 202. Horizontal end wall 261 covers the top or bottom longitudinal edge surfaces 111, 112 of the mirror stack 106. The corner reinforcement structures 226 have a complex multi-angled configuration formed on the opposing longitudinal end portions of the corrugated sheet 220, which includes (in order in adjoining contiguous relationship) a vertical inner wall 263 extending down along part of the upper and lower portions of the major side surfaces 110 of the stack 106, a horizontal lower cantilevered wall 262 projecting transversely outwards from vertical inner wall 263 and stack 106, a recurvant vertical outer wall 264 extending upwardly from wall 263 and spaced apart from and parallel to vertical inner wall 262, a horizontal upper cantilevered outer wall 265 extending inwards and perpendicularly from vertical outer wall 264, and a recurvant inner wall 266 extending diagonally downwards and obliquely to walls 264 and 265. Walls 264, 265, and 266 collectively form an internal triangle in shape and construction of the corner reinforcement structures 226 which extends diagonally completely across the longitudinal edge corners 114 of the stack 106 of mirrors 104 for optimum protection against corner impact forced F1. This contrasts to the external triangle shape and construction of corner reinforcement structures 126 of product packaging system 100 previously described herein. The diagonal inner wall 266 of corner reinforcement structure 226 extends diagonally across and protects the longitudinal corner edges 114 of the stack 106 as best seen in FIG. 2D. Inner wall 266 is obliquely angled to horizontal end wall 261 and inner vertical wall 263 of the corner reinforcement structure 226. Walls 264, 265, and 266 collectively define an open but enclosed interior space 269 within each rolled end 225 allowing some deformation of the rolled ends. An acute triangle may be formed by walls 264, 265, and 266.

Various orientations of the forgoing complex multi-angled configuration of corner reinforcement structures 226 are worth noting. Referring to FIG. 2D, the horizontal upper and lower cantilevered walls 265 and 263 are vertically spaced apart and parallel to each other, and parallel to the horizontal end wall of protective corrugated sheet 220. The vertical outer wall 264 is horizontally spaced apart from and parallel to the vertical inner wall 262. The diagonal inner wall 266 is obliquely angled to all walls 261, 262, 263, 264, and 265 of the corrugated sheet 220.

Similarly to product packaging system 100, the projection of the present corner reinforcement structures 226 outwards beyond the stack 106 of mirrors 104 form a protective gap G between the outer shipping carton 130 and the stack of mirrors in areas of the stack and package 202 between the corners regions (e.g. along the major side surfaces 110, a top longitudinal edge surface 111, opposing bottom longitudinal edge surface 112, and opposing first and second end surfaces 113 of stack 106). Accordingly, this enables the outer shipping carton 130 to deform and deflect to a degree for at least some protection against impacts directed at the assembled mirror package 202 between the corner regions. In some embodiments, additional reinforcement materials such as expanded polyethylene (EPE) foam, Styrofoam, or other materials may optionally be inserted in the gaps G of the product package 102 to increase impact resistance in these non-corner regions.

Product packaging system 200 further includes top and bottom protective pads 280, 281 which may be an expanded polyethylene (EPE) foam pad in one embodiment placed on the corrugated sheets 220 over the top/bottom surfaces 111, 112 of the stack 106. In one embodiment, pads 280, 281 may be approximately 2 cm thick as one non-limiting example; however, other thicknesses may be used. In one embodiment, the protective pads 280, 281 may be disposed in an outwardly open channel 267 formed between each corner reinforcement structure 226 of the protective corrugated sheet 220. One channel 267 is upwardly open at the top longitudinal edge surface 111 of stack 106 and the other is downwardly open at the bottom longitudinal edge surface 112 of the stack. Each of the top and bottom protective pads 280, 281 is nested in the protective corrugated sheets 220 may have a height substantially the same as the depth of the channels 267 so as to be substantially flush with the top and bottom surfaces of the corner reinforcement structures 226 (see, e.g. FIG. 2D). Protective corrugated sheets 220 each define an inwardly open channel 268 for receiving the top and bottom longitudinal edge surfaces 111, 112 therein respectively as shown.

To protect the end surfaces 113 of the stack 106, each end surface is covered by a protective end assembly 291 including a deformable EPE protective end pads 240 and a U-shaped corrugated sheet 290 covering the end pad. Each pad 240 is nested inside a U-shaped corrugated sheet which extends inwards onto a portion of the major side surfaces 110 (front and rear) of the stack 106 of mirrors 104. This provides protection against impact forces F3 acting on the ends 131 of the shipping carton 130 (see, e.g. FIG. 1A).

Once assembled as shown in FIG. 2B, the product package 202 with stack 106 of mirrors 104 with the aforementioned packaging thereon is placed into the master shipping carton 130 as shown in FIG. 2C.

In some embodiments, the stack 106 of mirrors 104 in product package 202 may be banded together similarly to product package 102 by threading bands 150 through the protective corrugated sheets 220 in a manner analogous to that already described herein (i.e. band threaded through the corner reinforcement structures 226 and around the stack). In other embodiments, the banding may be omitted.

A method for packaging a product such as mirrors 104 using the product packaging system 200 may be summarized as follows. The method generally includes: arranging the mirrors 104 in abutting relationship (e.g. face-to-face and back-to-back) to form the stack 106; positioning one of the two protective corrugated sheets 220 against each of the top longitudinal edge surface 111 and bottom longitudinal edge surface 112; positioning the top and bottom protective pads 280, 281 in channels 267 of the protective corrugated sheets 220 over the top and bottom surfaces 111, 112 of the stack 106; positioning the protective end pad assemblies 291 against each of the end surfaces 113 of stack 106 (noting the end pad assemblies may optionally be temporarily attached to the stack with tape to maintain their positions when placing the package 202 into the carton); inserting product package 202 comprising the foregoing components inside the cavity 135 of the shipping carton 130; and closing the flaps 134*a* on the carton to secure the contents. Variations in the method and sequence of steps may be used in some embodiments. For example, the protective end pad assemblies 291 may be placed and positioned against the stack 106 before placement of the top and bottom protective pads 280, 281.

Figure 3A:
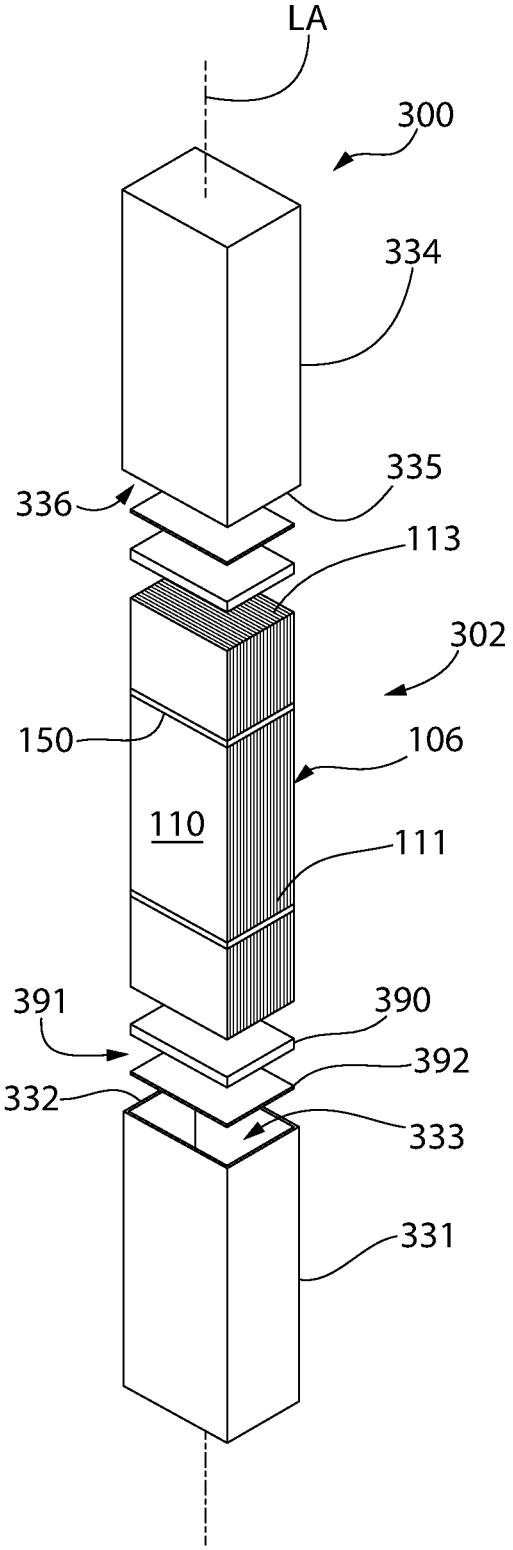
FIG. 3A is an exploded perspective view of a packaged product in accordance with a third embodiment of the present invention.
Figure 3B:
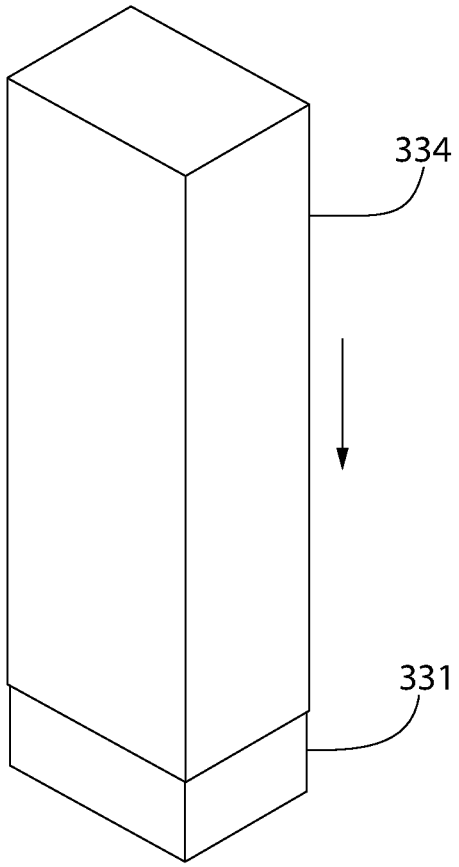
FIG. 3B is a fully assembled view of the packaged product of FIG. 3A.

FIGS. 3A-3B illustrate a third embodiment of a product packaging system 300 according to the present invention. Specifically, FIGS. 3A-3B illustrate various sequential stages in a method or process of packaging a set of products into a product package 302 for placement in an outer shipping container or carton 330 which is telescoping in design. Shipping carton 330 may be a heavy duty paper corrugated double-wall full overlap master carton as shown in FIG. 1C with a 200# test rating. In this configuration, however, carton 330 includes an inner container 331 having an open top end 332 to access an internal cavity 333, and an associated outer container 334 having an open bottom end 335 to access an internal cavity 336. It bears noting that the open top and bottom designations correspond to the orientation of carton 330 as shown in FIGS. 3A-3B for convenience recognizing that the carton may have any orientation. The outer container 334 is dimensionally larger than the inner container 331 in transverse cross section so that cavity 336 of the outer container slideably receives the inner container therein.

In the embodiment of FIGS. 3A-3B embodiment, again the mirrors are placed front-to-front and back-to-back in a stack that in one configuration may include twenty of the mirrors. Of course, stacks of less than twenty (for example, eight, ten, etc.) or even more than twenty of the mirrors may be used in other embodiments.

To protect the end surfaces 113 of the stack 106 of mirrors 104, each end surface is covered by a protective end assembly 391 including a deformable protective end pads 390 and medium density fiberboard (MDF) sheet 392 covering the end pad. This provides protection against impact forces F3 acting on the ends of the shipping carton 330. MDF sheets 392 may have a thickness of about 6 mm in one embodiment; however, other thicknesses may be used. In this embodiment, end pad 390 may be an expanded polystyrene (EPS) foam pad which is placed directly on the top and bottom surfaces of the stack of mirrors. The EPS foam pad may be approximately 2.5 cm thick in one non-limiting embodiment as a representative example; however, other thicknesses may be used. Then, the MDF sheet 392 is placed atop the exposed surface of the EPS foam pad. In one embodiment, as shown, the protective end pad 390 and MDF sheet 392 may have a flat and rectilinear configuration. Preferably, the pad and MDF sheet are configured to cover the entire end surface 113 of the mirror stack 106.

Next, once the protective end assemblies 391 are in place as shown and the stack of mirrors 104 is inserted into the inner container 331, the outer container 334 of the master carton 330 is slipped over the inner container to close the package. The fully assembled product package 302 with stack 106 of mirrors 104 in accordance with this embodiment is illustrated in FIG. 3B.

Figure 4A:
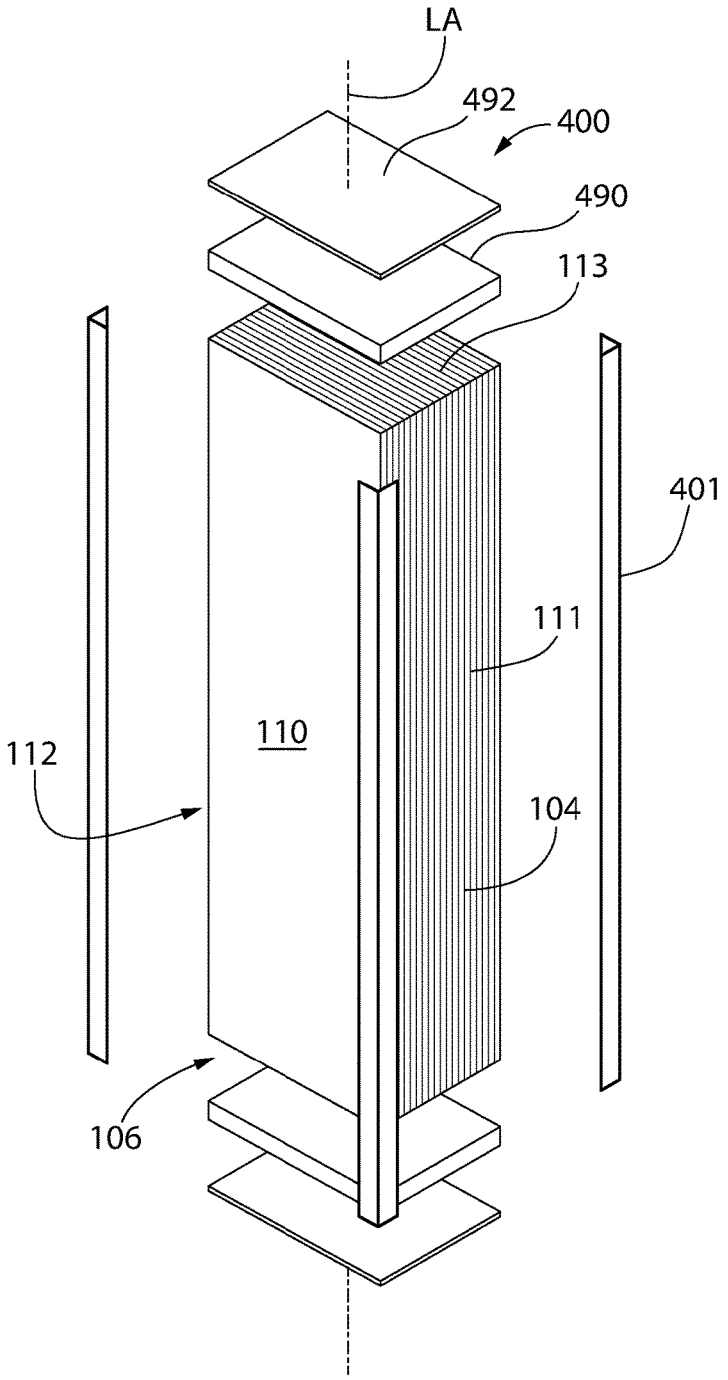
FIG. 4A is an exploded perspective view of a packaged product in accordance with a fourth embodiment of the present invention.
Figure 4B:
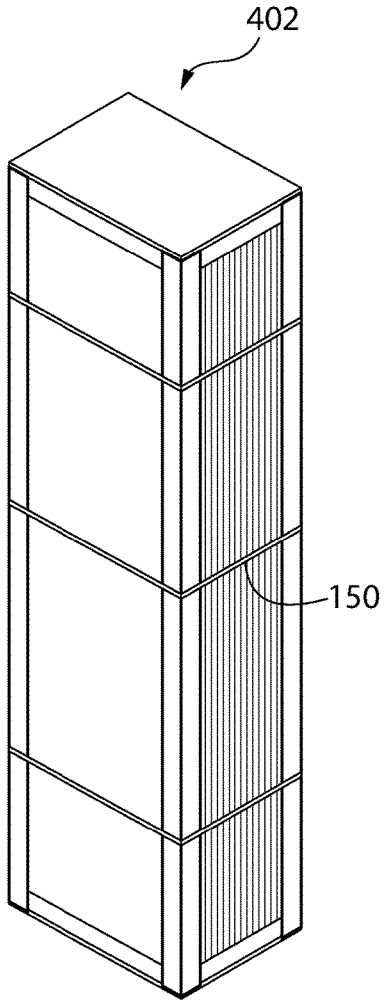
FIG. 4B is a partially assembled view of the packaged product of FIG. 4A.
Figure 4C:
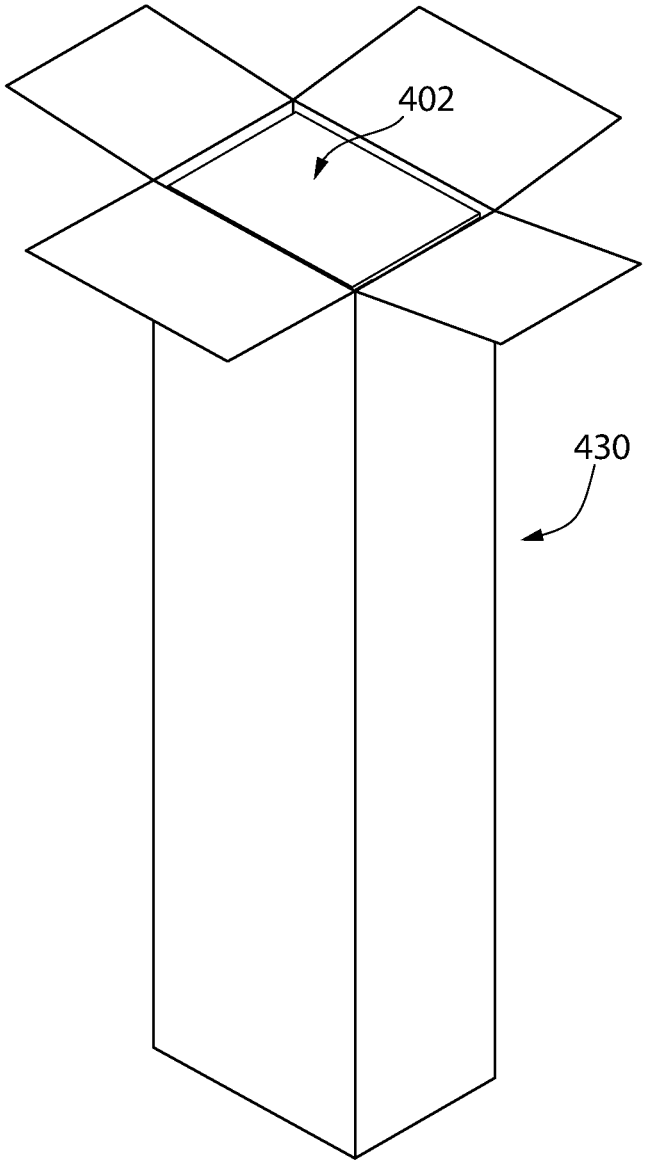
FIG. 4C is a fully assembled view of the packaged product of FIG. 4A.

FIGS. 4A-4C illustrate a fourth embodiment of a product packaging system 400 according to the present invention. Specifically, FIGS. 4A-4D illustrate various sequential stages in a method or process of packaging a set of products into a product package 402 for placement in an outer shipping container or carton 430. Shipping carton 430 may be a heavy duty paper corrugated double-wall full overlap master carton as shown in FIG. 1C with a 200# test rating. In this configuration, however, carton 430 includes an open top end 431 with end flaps in lieu of an open side like carton 130 with side flaps (see, e.g. FIG. 1C).

In this embodiment, again the mirrors 104 may be placed front-to-front and back-to-back in the stack 106 previously described herein which may include ten of the mirrors (more or less than ten of the mirrors may be used in other embodiments). In this embodiment, the protective end assemblies 391 including the EPS foam protective end pad 390 and a MDF sheet 392 are placed on the end surfaces 113 of the stack 106 of mirrors 104 as with the previous embodiment shown in FIG. 3A previously described herein. However, in this embodiment, a longitudinally-extending L-shaped hard solid paper corner board 401 is placed along each of the longitudinal corner edges 114 of the stack 106 of mirrors 104 at the intersection of the first and second major side surfaces 110 with the top and bottom surfaces 111, 112 of the stack. Next, as shown in FIG. 4B the unit is banded together by securing straps or bands 150 around the circumference of the stack 106 of mirrors 104 with the EPS foam protective pads 490, the MDF sheets 492 and the paper corner boards 401 positioned as shown are ready for placement in the carton 430. The banding 150 extend over and holds the corner boards 401 in position on the stack 106. Finally, as shown in FIG. 4C, this unit is placed in a full overlap master carton 430.

Figure 5A:
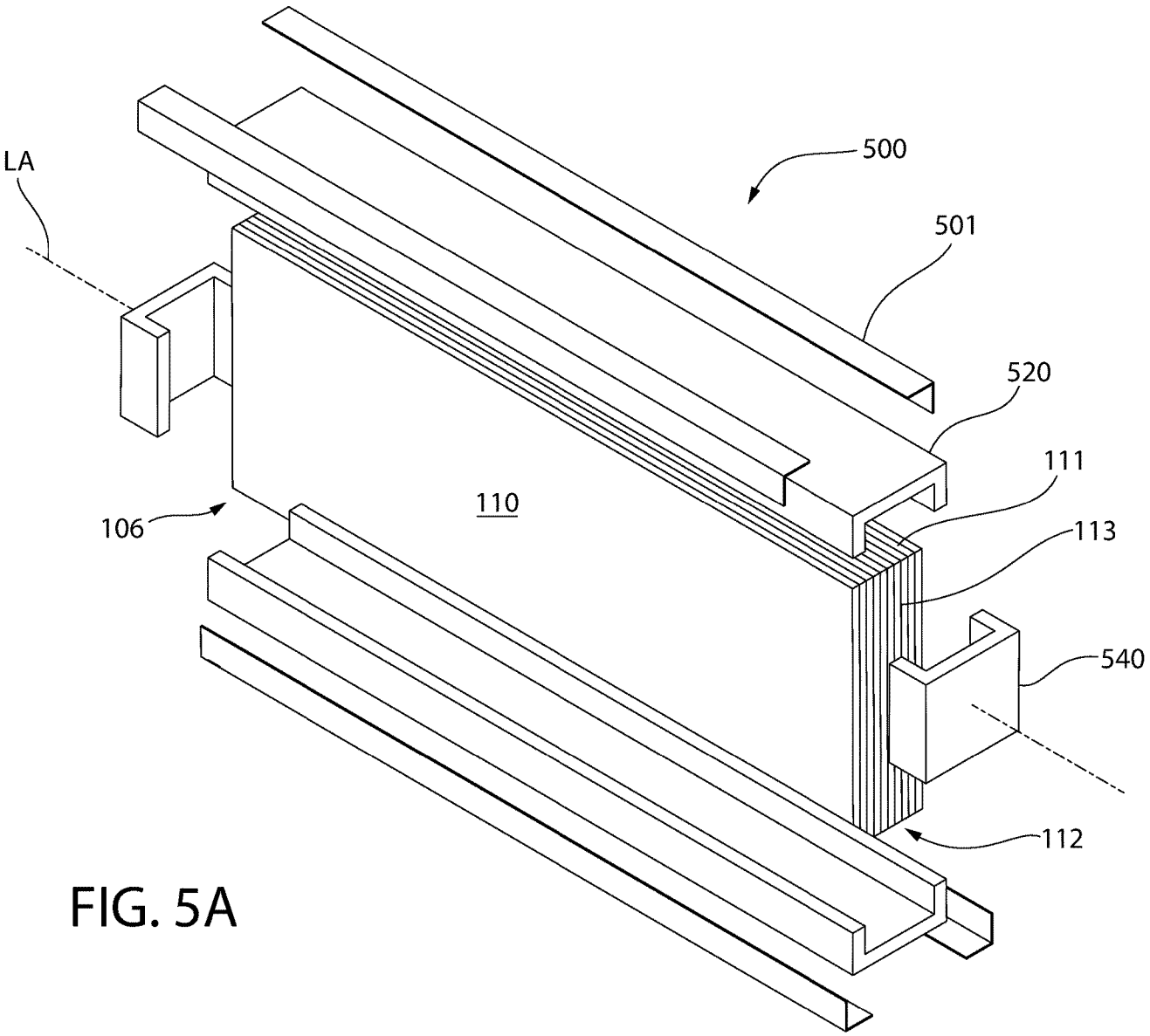
FIG. 5A is an exploded perspective view of a packaged product in accordance with a fifth embodiment of the present invention.
Figure 5B:
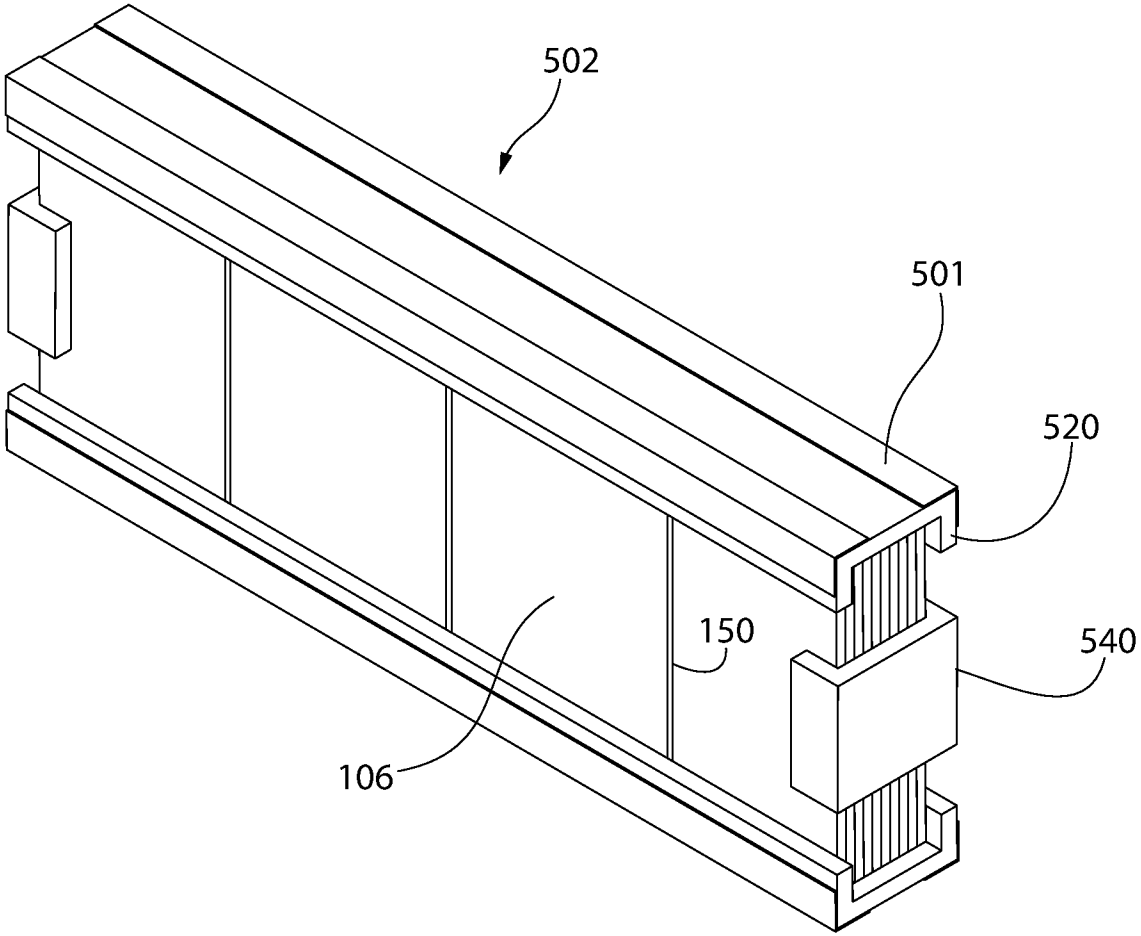
FIG. 5B is a partially assembled view of the packaged product of FIG. 5A.
Figure 5C:
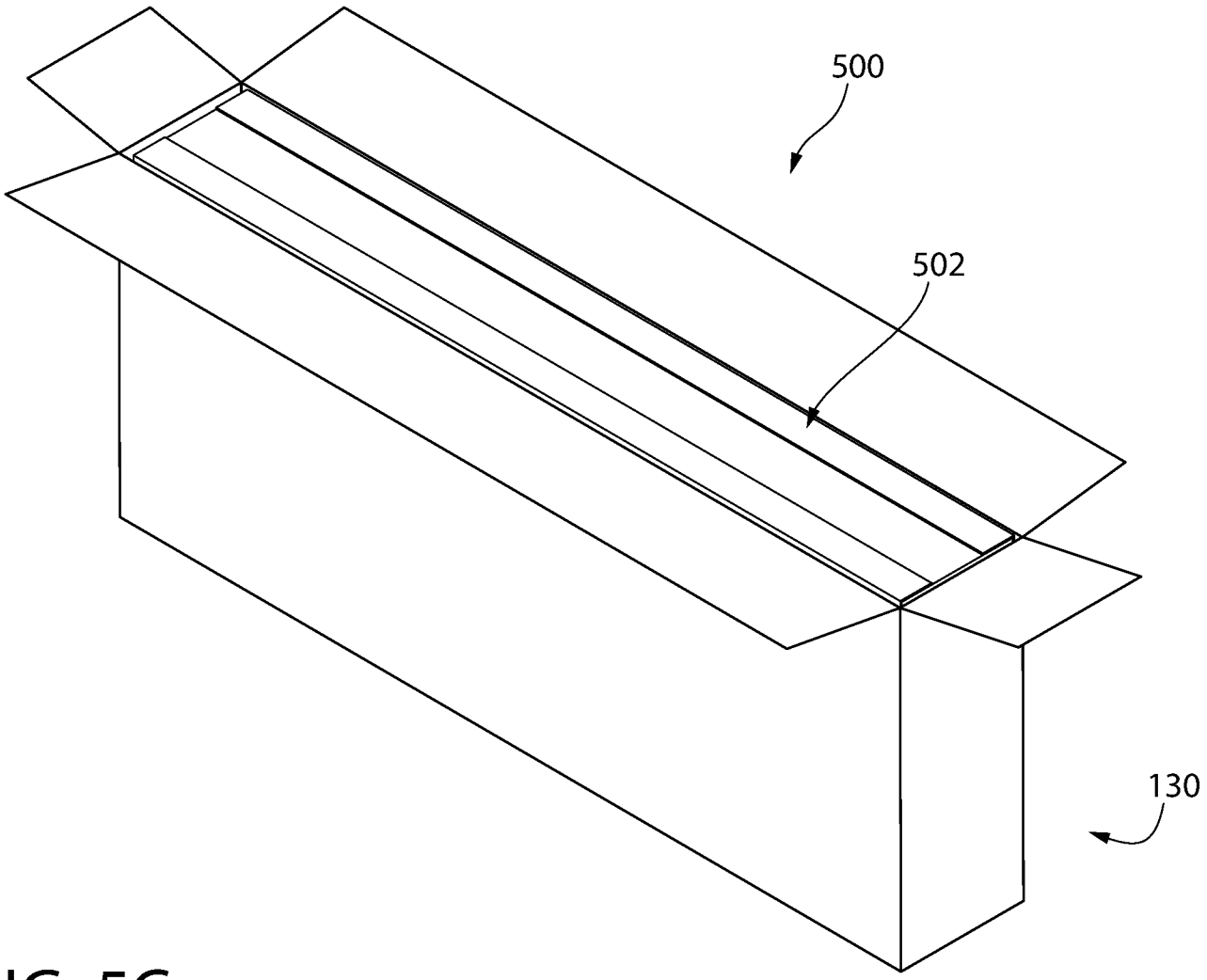
FIG. 5C is a fully assembled view of the packaged product of FIG. 5A.

FIGS. 5A-5C illustrate a fifth embodiment of a product packaging system 500 according to the present invention. Specifically, FIGS. 1A-1D illustrate various sequential stages in a method or process of packaging a set of products into a product package 502 for placement in an outer shipping container or carton 130. In this embodiment, a deformable and longitudinally-extending U-shaped protective pad 520 which may be formed of EPE is placed around the top and bottom surfaces 111, 112 of the stack 106 of mirrors 104. The opposing arms of the protective top and bottom pads 520 partially cover top and bottom portions of the adjoining major side surfaces 110 (e.g. front and rear) of the stack 106 as shown. The end surfaces 113 of the stack of mirrors 104 are each protected by a similar U-shaped protective end pad 540 which also partially cover end portions of the adjoining major side surfaces 110 (e.g. front and rear) of the stack 106.

A longitudinally-extending L-shaped hard solid paper corner board 501 is placed along each of the longitudinal corner edges 114 of the stack of mirrors at the intersection of the first and second major side surfaces to the top and bottom surfaces. Corner boards 501 may be similar to corner boards 401 previously described herein. The L-shaped corner boards 501 are positioned on top of and partially cover the U-shaped top and bottom pads 520 rather than directly in contact with the stack 106 of mirrors 104, thus providing an added layer of protection to the corners/edges of the stack of mirrors in addition to that which is provided by the U-shaped foam pads.

The stack 106 of mirrors 104 may be banded together by bands 150. In some embodiments, the U-shaped protective top and bottom pads 520 and corner boards 501 be may be secured to the product package under the banding 150. The U-shaped protective end pads 540 may optionally be taped to the stack 106 to hold their positions until insertion into the shipping carton 130. In other embodiments, the pads 520 and 540 are not attached to the stack 106 as shown in the illustrated embodiment.

Finally, as shown in FIG. 5C, the assembled product package 502 including the stack 106 of mirrors 104 with the EPE protective pads 520, 540 and the hard solid paper corner boards 501 is placed in a full overlap master carton 130.

A method for packaging a product such as mirrors 104 using the product packaging system 500 may be summarized as follows. The method generally includes: arranging the mirrors 104 in abutting relationship (e.g. face-to-face and back-to-back) to form the stack 106; positioning the protective top pad 520 on the top longitudinal edge surface 111 of the stack and the bottom pad 520 on the bottom surface of the stack; positioning the longitudinal corner boards 501 on the top and bottom pads 520 at the corners of the pads; positioning the protective end pads 540 on each end surface 113 of the stack; inserting the assembled product package 502 with the foregoing components inside the cavity 135 of the shipping carton 130; and closing the flaps 134*a* on the carton to secure the contents. Variations in the method and sequence of steps may be used in some embodiments.

Figure 6A:
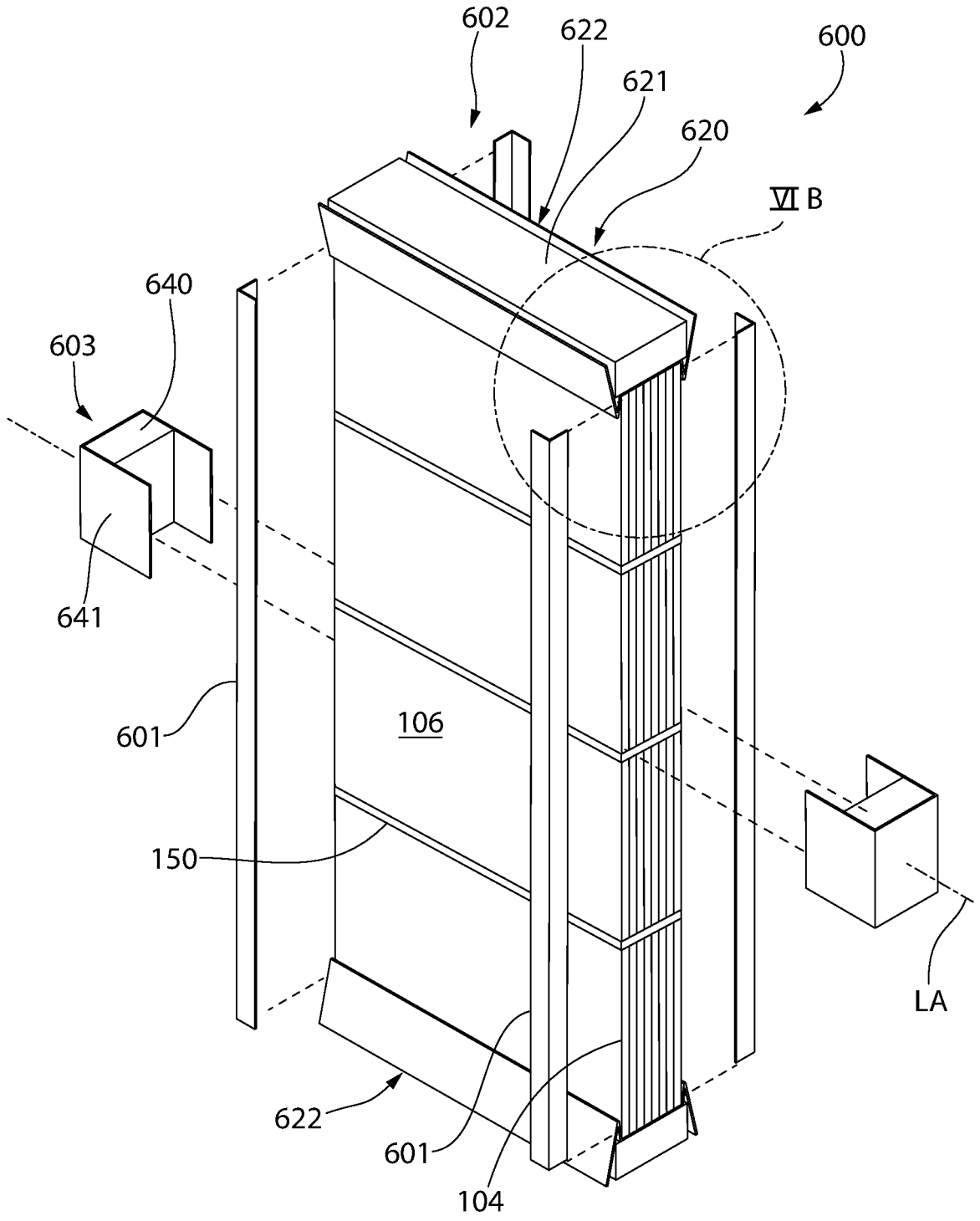
FIG. 6A is a partially exploded perspective view of a packaged product in accordance with a sixth embodiment of the present invention.
Figure 6B:
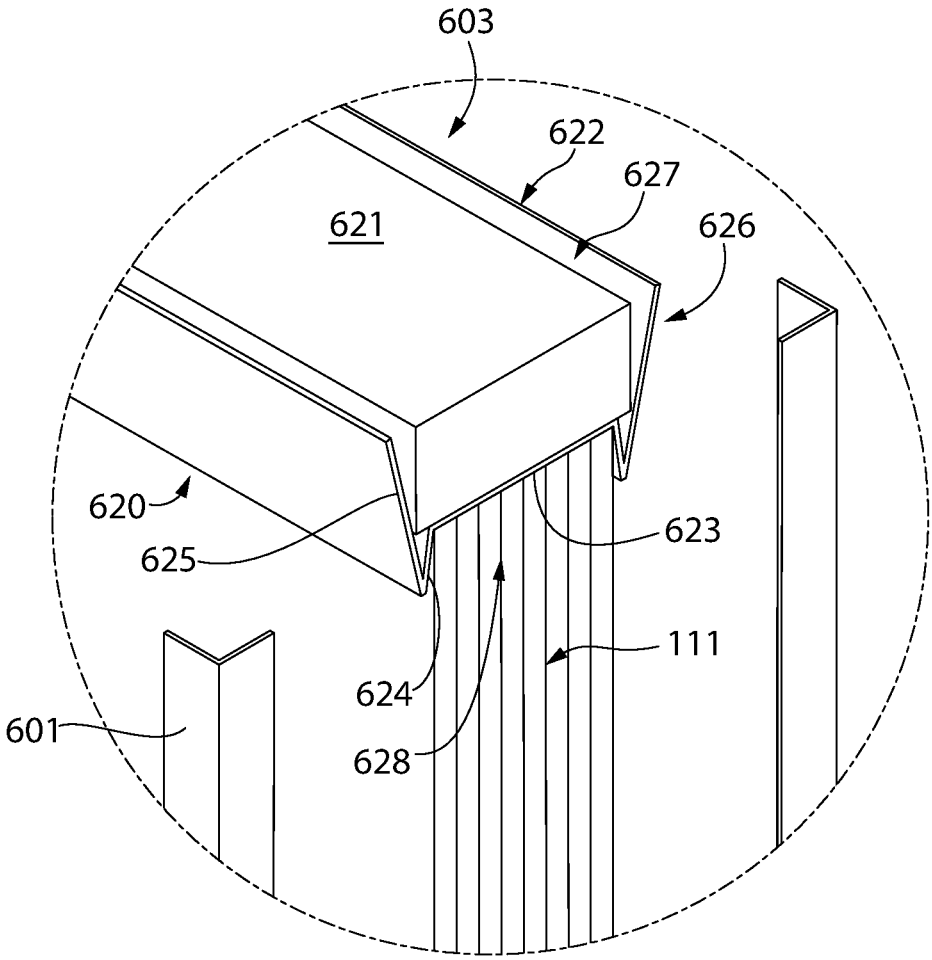
FIG. 6B is a detailed end view taken from FIG. 6A.

FIGS. 6A-B illustrates a sixth embodiment of a product packaging system 600 according to the present invention. This embodiment, similar to some of the ones described previously, uses a combination of specially-configured paper corrugate, foam protective pads, and corner boards (i.e., solid paperboard) placed strategically around the stack 106 of mirrors 104 to protect the stack of mirrors from damage during transit. In this embodiment, again the mirrors 104 in the product package 602 may be placed front-to-front and back-to-back in the stack 106 previously described herein. The stack 106 may include any number of mirrors 104, such as for example eight mirrors (other embodiments may include more or less mirrors). Any of the shipping cartons disclosed may be used with the present embodiment. In one embodiment, shipping carton 130 is used as an example without limitation for convenience of description.

In the present embodiment of FIGS. 6A-B, the end surfaces 113 of the stack 106 of mirrors 104 are each covered and protected by a protective end assembly 620. Assembly 620 includes a deformable EPE or EPS foam protective pad 621 and a generally double U-shaped protective corrugated sheet 622. Each pad 621 is nested at least partially inside an outwardly open channel 627 of the corrugated sheet 641. Corrugated sheet 641 includes a pair of folded flexible V-shaped wings 626 formed along opposing peripheral lateral edges of the sheet which form part of the overall U-shape. Each wing 626 includes a first angled wall 624 extending in a first direction from a flat horizontal wall 623 which covers the entire end surface 113 of mirror stack 106, and a second angled wall 625 extending in a second opposite direction from the first angled wall 624. Angled walls are inwardly movable and collapsible when the product package 602 inside the shipping carton via engagement with carton walls. The pair of second angled walls 625 collectively define the outwardly open channel 627. The first angled walls 624 extend downwards onto a portion of the major side surfaces 110 (front and rear) of the stack 106 of mirrors 104 and define a second inwardly open channel 628 which receives the edge of the mirror stack 106 therein. This provides protection against impact forces F3 acting on the ends of the shipping carton (force direction shown in FIG. 1C). In one embodiment, each protective edge assembly 620 may have a length which extends for the entire exposed end surfaces 113 of the stack 106 of mirrors 104.

A longitudinally-extending L-shaped hard solid paper corner board 601 is placed along each of the longitudinal corner edges 114 of the stack 106 of mirrors 104 at the perpendicular intersection of the first and second major side surfaces 110 to the top and bottom surfaces 111, 112. Corner boards 601 may be similar to corner boards 401 previously described herein. The L-shaped corner boards 601 extend vertically between the protective end assemblies 620 on each end surface 113 of the stack 106.

The top and bottom longitudinal edge surfaces 111, 112 of stack 106 of mirrors 104 are each covered and protected by a protective edge assembly 603. Assembly 603 includes a deformable EPE or EPS protective end pad 640 and a U-shaped corrugated sheet 641 covering the end pad. Each pad 640 is nested inside the U-shaped corrugated sheet 641 which extends inwards onto a portion of the major side surfaces 110 (front and rear) of the stack 106 of mirrors 104. This provides protection against impact forces acting on the long top 134 or bottom 136 sides of the shipping carton 130 (see, e.g. FIG. 1A). In one embodiment, each protective edge assembly 603 may have a length which extends for a majority of the top and bottom longitudinal edge surfaces 111, 112 of the mirror stack 106, and substantially all of the length in some embodiments sufficient to cover all portions of the longitudinal edge surfaces not covered by the protective end assemblies 620 described above The stack 106 of mirrors 104 may be banded together via bands 150 which may pass beneath the protective end assemblies 620. Finally, the assembled product package 602 including the stack 106 of mirrors 104 with the protective end assemblies 620, protective edge assemblies 603, and the hard solid paper corner boards 501 may be placed in any of the full overlap master cartons disclosed herein such as for example cartons 130 or 430, which are then closed.

FIGS. 7A-D illustrate a seventh embodiment of product packaging system 700 according to the present invention. This embodiment, similar to some of the ones described previously, uses a combination of specially-configured paper corrugate. In this embodiment, again the mirrors 104 in the product package 702 may be placed front-to-front and back-to-back in the stack 106 previously described herein. The stack 106 may include any number of mirrors 104, such as for example eight mirrors (other embodiments may include more or less mirrors). Any of the shipping cartons disclosed may be used with the present embodiment. In one embodiment, shipping carton 130 is used as an example without limitation for convenience of description.

To protect the end surfaces 113 of the stack 106 collectively defined by mirrors 104, each end surface is covered by a specially configured three-dimensional and laterally-extending protective corrugated sheet 720 (e.g. 150# B-flute corrugated sheet in the exemplified embodiment) folded to form an end cap 722 as shown. This provides protection against impact forces F3 acting on the ends 131 of the shipping carton 130 (see, e.g. FIG. 1A).

Corrugated end cap 722 includes a pair of opposing stub walls 723 and elongated sidewalls 724 extending therebetween having a greater length than the stub walls. Sidewalls 724 are spaced apart and define an inwardly open internal cavity 725 (i.e. facing the stack 106) configured to receive the end portions of the mirror stack therein, thereby covering and protecting the end surfaces 113 of the stack from damage. Stub walls 723 and sidewalls 724 may be three-dimensional, double-walled structures each including two outer walls defining an open interior space 726 therebetween providing a crush zone. A laterally extending end wall 727 is formed at the bottom of the cavity 725 which abuttingly engages the end surfaces 113 of the stack 160 of mirrors 104 when inserted into the cavity. A plurality of protective projections 732 are formed by end cap 722 which extend outwards from the end wall 727 to engage the ends 131 of the shipping carton 130 when the product package 702 is placed inside. The projections 732 add structure rigidity to the end cap 722 and a crush zone for withstanding forces F3 imparted and directed onto the ends of the carton 130 such as from dropping the carton.

Figure 7A:
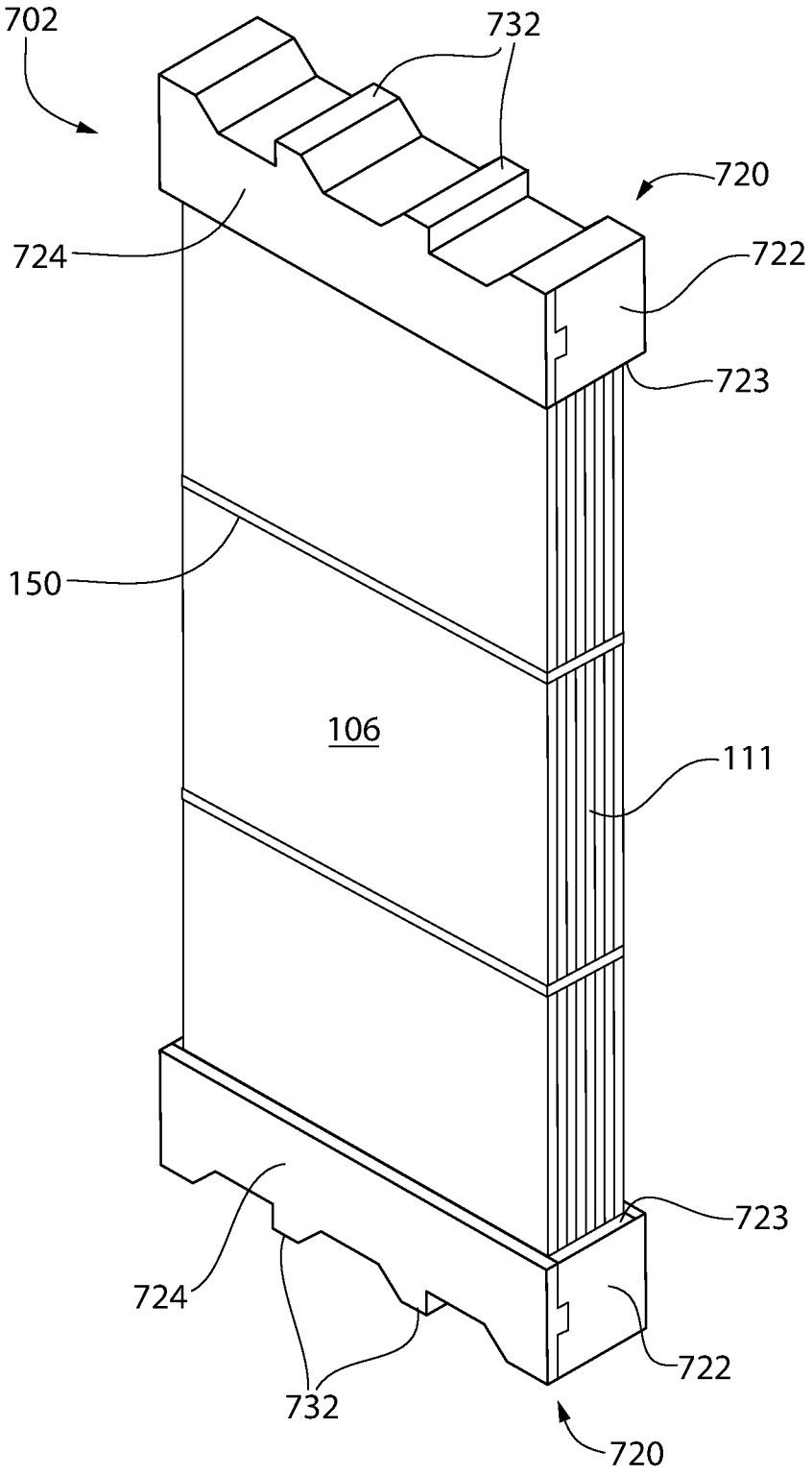
FIG. 7A is a perspective view of a packaged product in accordance with a seventh embodiment of the present invention.
Figure 7B:
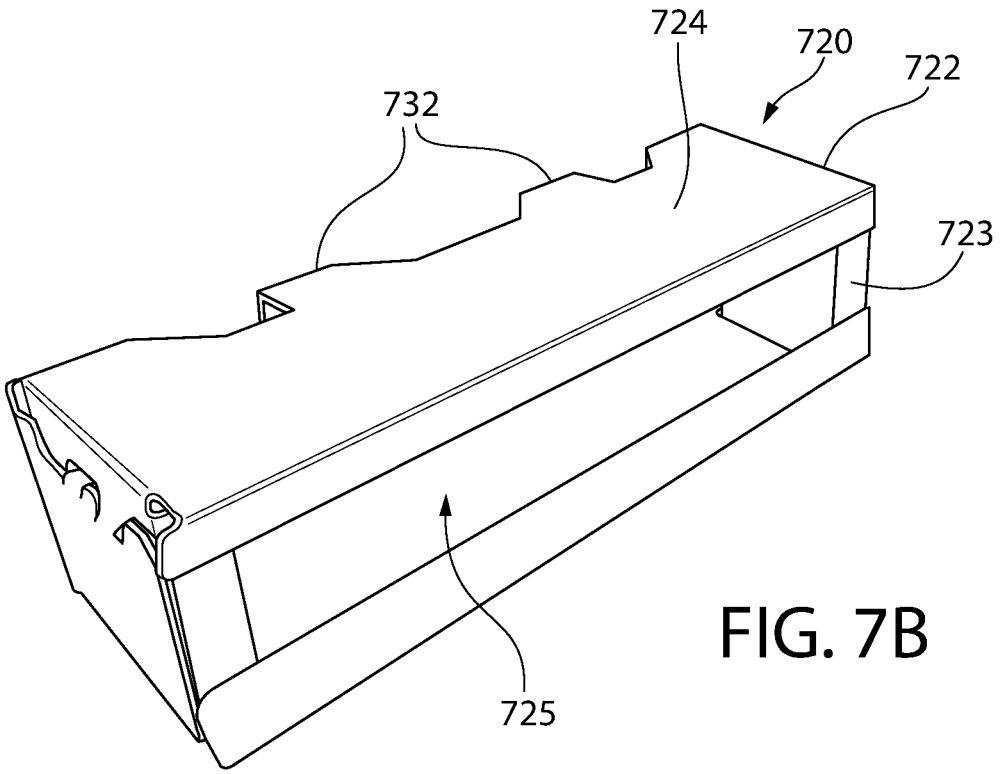
FIGS. 7B and 7C are perspective views thereof.
Figure 7C:
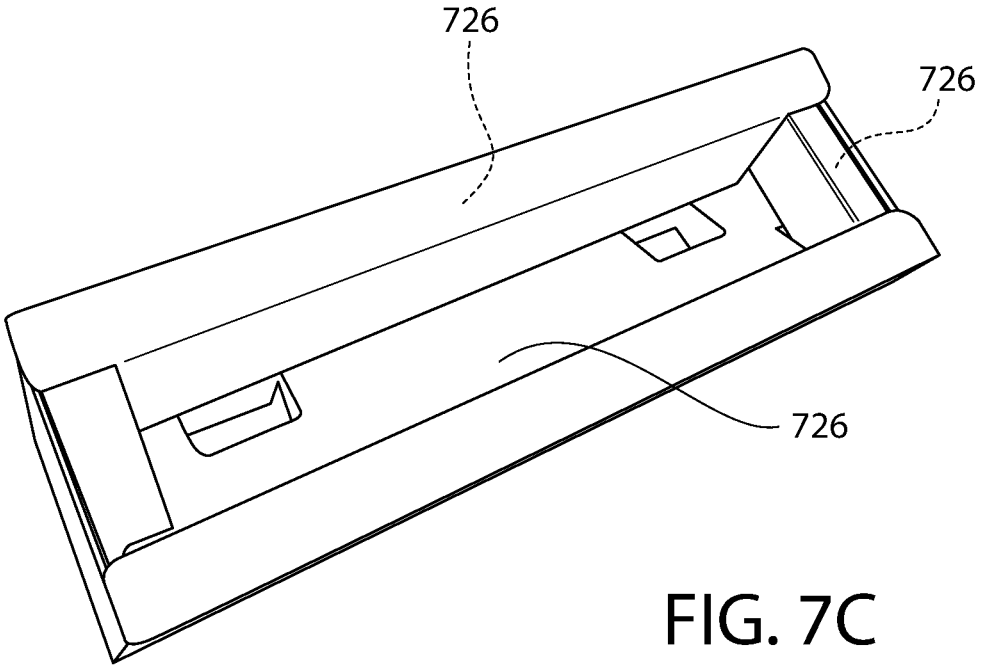
Figure 7D:
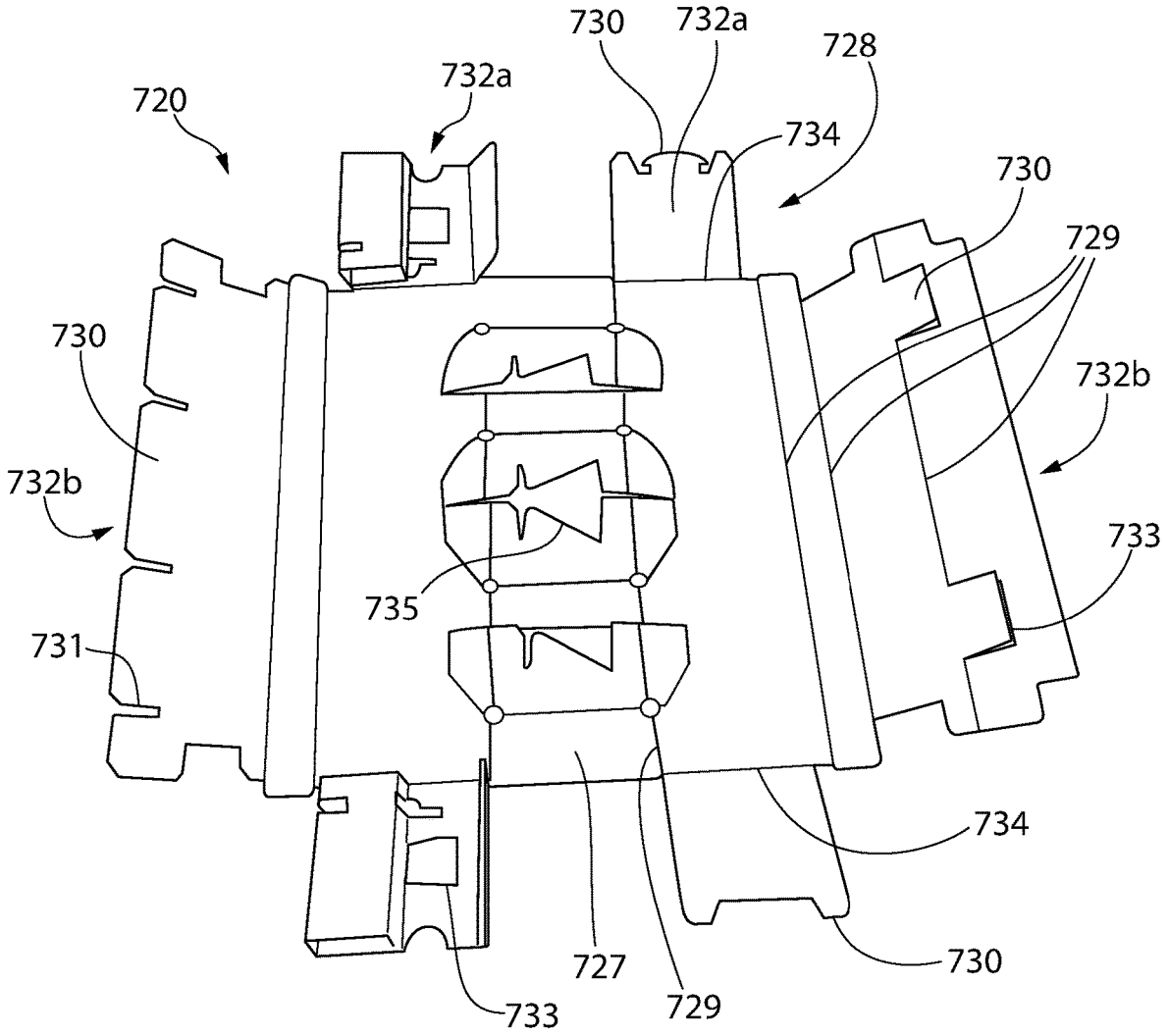
FIG. 7D is a perspective view showing the protective corrugated sheet of the package product of FIG. 7A in a preassembled unfolded condition.

The corrugated end cap 722 may be formed from a single monolithic unitary piece of flat single-corrugated paper stock sheet 728 which is bent, folded, and assembled to create the final three dimensional structure best shown in FIGS. 7B-C. FIG. 7D shows the unfolded/unassembled paper stock sheet 728. Corrugated paper stock sheet 728 has a generally polygonal perimeter configuration and includes a plurality of parallel major crease or bend lines 729 extending for a majority of the length of the sheet. Bend lines 729 are laterally spaced apart at intervals to primarily define the sidewalls 624 when the stock sheet is folded to shape. Major bend lines 729 are thus oriented parallel to the length of the sidewalls 724. A plurality of tabs 730, slots 731 (some of which receive a mating tab to form a mechanical interlock feature), flaps 732 (including end flaps 732*a*, side flaps 732*b*, and interior flaps 732*c*), openings 733, and minor bend lines 734 (oriented parallel and/or perpendicular to major bend lines 729) are each formed throughout the paper stock 728 which can be folded to form the remaining parts of the end cap 722 folded construction such as the stub walls 726 and protective projections 732. The side flaps 732*b* are folded and interlocked with the structure to form the sidewalls 724. The end flaps 732*a* are folded and interlocked to primarily form the stub walls 723. In one embodiment, the end wall 727 may include several interior openings 735 which define the interior flaps 732*c* which in turn are folded to form the three-dimensional protective end projections 732 of the end cap 722.

The stack 106 of mirrors 104 may be banded together via bands 150 which may pass beneath the corrugated protective end caps 722. Finally, the product package 702 including the protective end caps 722 and mirror stack 106 are placed inside the shipping carton.

In one embodiment, the corrugated end cap 722 may be used alone as the only packing materials for protecting the stack 106 of mirrors 104. However, in other embodiments, additional protective packing materials including any of the other protective members disclosed in other embodiments herein may be used on the remaining portions of the mirror stack 106 not protected by the corrugated end caps 722.

Although the corrugated end caps 722 are described and shown in the illustrated embodiment as being intended for use on the short side of the mirror stack end surfaces 113, in other embodiments the end caps 722 may be used on the long side of the mirror stack top and bottom longitudinal edge surfaces 111, 112. The invention is therefore not limited to either placement of the corrugated end cap 722.

It further bears noting that any of the protective packaging members disclosed herein may be used on the short transverse end surfaces 113 or long longitudinal top and bottom longitudinal edge surfaces 111, 112 and major side surfaces 110 of the stack 106 of mirrors 104 in other embodiments regardless of the preferred placements described herein, which represent one possible placement option for these packaging members. In addition, any of the protective packaging members disclosed herein can be used in combination with any of the other protective packaging members disclosed in various other embodiments. Accordingly, the protective packaging members are not limited to use only in the exemplary embodiments and illustrated combinations. This provides a great deal of flexibility for the designer for modify the impact resistance of the protective product packages to maximize protection where it is needed most depending on the number and types of products in the stack.

It will be appreciated that although EPS and EPE are used herein to describe the material of the foam pads in the various embodiments, EPS and EPE may be interchangeable. Thus, if a specific embodiment indicates that EPS is used, EPE may be used in the alternative. Alternatively, if a specific embodiment indicates that EPE is used, EPS may be used in the alternative. In addition, other foam pad materials and compositions comprising open and/or closed cells may alternatively be used in the place of either EPS or EPE.

It will further be appreciated that any of the embodiments of a product packaging system disclosed herein may used banding to hold the stack 106 of mirrors 104 together even if not specifically noted.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A product packaging system comprising:

a longitudinal axis;

a stack of products arranged in abutting relationship, the stack defining a pair of opposing major side surfaces, a top surface, a bottom surface, and pair of opposing end surfaces;

a pair of protective corrugated sheets, each of the top and bottom surfaces of the stack covered by one of the protective corrugated sheets;

each protective corrugated sheet including a pair of longitudinally-extending protruding corner reinforcement structures, the corner reinforcement structures disposed along corner regions of the stack and extending a full length of each protective corrugated sheet from end to end;

a protective end assembly covering each of the end surfaces of the stack, the protective end assembly including a deformable protective end pads and a U-shaped corrugated sheet covering the end pad;

the stack of products, protective corrugated sheets, and protective end assemblies collectively defining a product package which is removably positioned inside an outer shipping container.

2. The product packaging system according to claim 1, further comprising banding wrapped transversely around the stack of products and threaded through each of the protective corrugated sheets to hold an assembly of the stack and protective corrugated sheets together.

3. The product packaging system according to claim 1, wherein the products each have a flat rectangular configuration.

4. The product packaging system according to claim 3, wherein the products are mirrors.

5. The product packaging system according to claim 4, wherein the mirrors each have a mirrored front side and a plain back side, and the mirrors are arranged in front side-to-front side and back side-to-back side in the stack.

6. The product packaging system according to claim 1, wherein each of the protective corrugated sheets includes a flat horizontal end wall extending transversely between the corner reinforcement structures and covering the top or bottom surface of the stack.

7. The product packaging system according to claim 6, wherein the corner reinforcement structures are formed on opposing longitudinal end portions of the horizontal end wall of the corrugated sheet and include a horizontal lower cantilevered wall supporting a contiguously adjoining vertical wall which supports a contiguously adjoining horizontal upper cantilevered wall parallel to the lower cantilevered wall of the protective corrugated sheet.

8. A product packaging system comprising:

a longitudinal axis;

a stack of products arranged in abutting relationship, the stack defining a pair of opposing major side surfaces, a top surface, a bottom surface, and pair of opposing end surfaces;

a pair of protective corrugated sheets, each of the top and bottom surfaces of the stack covered by one of the protective corrugated sheets;

each protective corrugated sheet including a pair of longitudinally-extending protruding corner reinforcement structures, the corner reinforcement structures disposed along corner regions of the stack;

a protective end assembly covering each of the end surfaces of the stack, the protective end assembly including a deformable protective end pads and a U-shaped corrugated sheet covering the end pad;

the stack of products, protective corrugated sheets, and protective end assemblies collectively defining a product package which is removably positioned inside an outer shipping container;

wherein each of the protective corrugated sheets includes a flat horizontal end wall extending transversely between the corner reinforcement structures and covering the top or bottom surface of the stack;

wherein the corner reinforcement structures are formed on opposing longitudinal end portions of the horizontal end wall of the corrugated sheet and include a horizontal lower cantilevered wall supporting a contiguously adjoining vertical wall which supports a contiguously adjoining horizontal upper cantilevered wall parallel to the lower cantilevered wall of the protective corrugated sheet; and further comprising a diagonal wall extending downwardly from the upper cantilevered wall and across a longitudinal corner edge of the stack.

9. A product packaging system comprising:

a longitudinal axis;

a stack of products arranged in abutting relationship, the stack defining a pair of opposing major side surfaces, a top surface, a bottom surface, and pair of opposing end surfaces;

a pair of protective corrugated sheets, each of the top and bottom surfaces of the stack covered by one of the protective corrugated sheets;

each protective corrugated sheet including a pair of longitudinally-extending protruding corner reinforcement structures, the corner reinforcement structures disposed along corner regions of the stack;

a protective end assembly covering each of the end surfaces of the stack, the protective end assembly including a deformable protective end pads and a U-shaped corrugated sheet covering the end pad;

the stack of products, protective corrugated sheets, and protective end assemblies collectively defining a product package which is removably positioned inside an outer shipping container;

wherein each of the protective corrugated sheets includes a flat horizontal end wall extending transversely between the corner reinforcement structures and covering the top or bottom surface of the stack;

wherein each corner reinforcement structure has a complex multi-angled configuration including a vertical inner wall extending down along part of the major side surfaces of the stack, a horizontal cantilevered wall projecting transversely outwards from the inner vertical wall, a recurvant vertical outer wall spaced apart from and parallel to vertical inner wall, a horizontal outer wall extending inwards and perpendicularly to vertical outer wall, and a recurvant inner wall extending diagonally downwards and obliquely to the horizontal cantilevered wall.

10. The product packaging system according to claim 1, wherein the corner reinforcement structures form protective gaps between inside surfaces of the shipping container and the stack of products.

11. The product packaging system according to claim 1, wherein the protective end pads are formed of expanded polyethylene or polystyrene foam.

12. The product packaging system according to claim 1, further comprising top and bottom protective pads each positioned on a respective one of the protective corrugated sheets on the top and bottom surfaces of the stack.

13. The product packaging system according to claim 12, wherein each protective corrugated sheet includes an outwardly open channel receiving one of the top or bottom protective pads fully therein.

14. The product packaging system according to claim 1, wherein each of the protective corrugated sheets including the pair of longitudinally-extending protruding corner reinforcement structures have an identical configuration.

* * * * *